US010580328B2

(12) United States Patent
Liversidge et al.

(10) Patent No.: US 10,580,328 B2
(45) Date of Patent: Mar. 3, 2020

(54) SAFETY COLLAR FOR AN ELECTRICAL CABLE

(71) Applicant: Tavismanor Limited, Colchester (GB)

(72) Inventors: Barry Peter Liversidge, Colchester (GB); George Henri Liversidge, Colchester (GB)

(73) Assignee: TAVISMANOR LIMITED, Colchester (GB)

( * ) Notice: Subject to any disclaimer, the term of this patent is extended or adjusted under 35 U.S.C. 154(b) by 9 days.

(21) Appl. No.: 15/568,915

(22) PCT Filed: Apr. 22, 2016

(86) PCT No.: PCT/GB2016/051134

§ 371 (c)(1),
(2) Date: Oct. 24, 2017

(87) PCT Pub. No.: WO2016/170362

PCT Pub. Date: Oct. 27, 2016

(65) Prior Publication Data

US 2018/0286289 A1 Oct. 4, 2018

(30) Foreign Application Priority Data

Apr. 24, 2015 (GB) ..... 1506980.0
Apr. 24, 2015 (GB) ..... 1506982.6
Apr. 24, 2015 (GB) ..... 1506985.9

(51) Int. Cl.
*H01B 7/36* (2006.01)
*G09F 3/00* (2006.01)
(Continued)

(52) U.S. Cl.
CPC ..... *G09F 3/0295* (2013.01); *G09F 3/205* (2013.01); *H01B 7/368* (2013.01); *H01R 13/465* (2013.01); *H01R 9/03* (2013.01)

(58) Field of Classification Search
CPC ..... G09F 3/0295; G09F 3/205; H01B 7/368; H01R 13/465; H01R 9/03
See application file for complete search history.

(56) References Cited

U.S. PATENT DOCUMENTS 1,788,354 A 1/1931 Alden
4,363,180 A * 12/1982 Lucas ..... H01B 7/368 40/316

(Continued)

FOREIGN PATENT DOCUMENTS

DE 3247932 5/1984
DE 3314295 5/1984

(Continued)

OTHER PUBLICATIONS

International Search Report and Written Opinion dated Aug. 12, 2016, issued in PCT Patent Application No. PCT/GB2016/051134, 13 pages.

(Continued)

*Primary Examiner* — Cassandra Davis
(74) *Attorney, Agent, or Firm* — Grossman, Tucker, Perreault & Pfleger, PLLC

(57) ABSTRACT

An identification tag for an electrical cable. The identification tag may provide enhanced safety between the cable and another component, and may include a collar and a tab. The collar may include a bore for receiving a part of the cable. The bore may extend between first and second ends of the collar. The collar may also include an abutment surface for limiting the insertion of the cable end through the bore. The collar may further include an outer surface having a profile such that an outer diameter of the collar is smaller at the second end than at the first end and the outer diameter of the collar decreases gradually from the first end to the second end. The tab may be connected to and extend from the collar, (Continued)

wherein the tab may include identification symbols for identifying the cable.

26 Claims, 11 Drawing Sheets

(51) Int. Cl.
*G09F 3/20* (2006.01)
*H01R 13/46* (2006.01)
*H01R 9/03* (2006.01)

(56) References Cited

U.S. PATENT DOCUMENTS 4,764,126 A * 8/1988 Piana ..... H01R 11/11 439/491
4,861,280 A * 8/1989 Piana ..... H01R 43/20 439/491
4,969,845 A * 11/1990 Hauchard ..... H01R 11/11 439/750
5,017,161 A * 5/1991 Hauchard ..... H01R 4/20 439/750
5,445,544 A * 8/1995 Weiland ..... H01R 4/20 439/879
5,511,331 A * 4/1996 Morosini ..... G09F 3/04 40/316
7,552,849 B2 * 6/2009 Gouldson ..... A47G 25/1428 223/85
2009/0139743 A1 6/2009 Smith

FOREIGN PATENT DOCUMENTS

DE 4009229 5/1991
DE 4404590 8/1995
EP 0035460 9/1981
EP 0115055 8/1984
EP 0251054 7/1988
EP 1702539 9/2006
FR 2698728 A1 * 6/1994 ..... H01R 4/305
GB 2173053 A * 10/1986 ..... H01R 11/11
GB 2528470 1/2016

OTHER PUBLICATIONS

Search Report dated Oct. 18, 2016, issued in United Kingdom Application No. GB1607055.9, 3 pages.
Search Report dated Oct. 18, 2016, issued in United Kingdom Application No. GB1607054.2, 3 pages.

* cited by examiner

SAFETY COLLAR FOR AN ELECTRICAL CABLE

BACKGROUND

This invention relates to an identification tag for fitting on to an electrical cable to provide enhanced safety at a connection between the cable and another component and also cable identification. The invention further relates to a method of providing electrical shielding and identification for a cable at a connection between the cable and an electrical component.

This invention may be used in many electrical wiring situations, though it is primarily concerned with the safety and identification of electrical cables connected to single phase and three phase electricity meters. As such, the invention will be described hereinafter solely in relation to this situation though it is to be understood that the invention is not limited to this.

In many electrical wiring installations, it is essential that adequate safety be assigned to a connection between an electrical cable and a component to which the cable is connected. Further, it may be advantageous, or sometimes a requirement of the wiring regulations, to provide an identification of a cable carrying mains electricity, including easily visible and clear markings. A particular case in point is with supply cables connecting an incoming electrical supply to an electricity meter and feed cables connecting the electricity meter to an isolator switch, a consumer unit for distribution around a building or other electrical component.

The supply and feed cables to an electricity meter are usually referred to as "tails" and, for the domestic environment, normally have conductors of 25 $mm^2$ cross-section or 16 $mm^2$ cross-section. The electrical cables typically have a layer of insulation around the conductors and an outer sheath surrounding the insulation. Often, the insulation and sheath (if provided) are of a uniform grey colour and so do not serve to identify the whether the cable is a "live" or "neutral" cable. In some cases, however, one or both of the sheath and inner insulation may be coloured to denote the polarity of the electrical cable.

When a cable is to be connected to an electricity meter, the insulation and, if provided, the outer sheath must be cut away to expose the conductors which are then fitted into a connector within the meter and are clamped in place by means of screws provided as a part of the connector. It is important that there is no access to the conductors of the cable or the connector of the meter in the region of the connection. This is important for safety purposes, and also in order to prevent fraudulent tapping of electricity from the supply cables to the meter before the electricity has been metered.

In order to enhance the safety of the connections at an electricity meter and also to restrict access to the conductors of the cable or the connectors of the meter, it is known to provide the connectors within a meter housing at the inner end of a recess in the housing. Such a recess may be of uniform circular cross-section or may be generally conical. Further, it is known to provide an upstanding external rim on the housing around the recess leading to the connectors. With this arrangement the object is to ensure that the conductors of the cable cannot be accessed once fitted to the connector within the meter housing.

Following the preparation of an end portion of the cable by stripping away the insulation and the outer sheath to expose a pre-set length of the cable conductors, it is also known to fit a flanged collar to the cable. The flanged collar effectively enlarges the diameter of the cable at cut end of the insulation and aims to provide enhanced safety by reducing access to the conductors and the connectors within the meter. Most of the known collars have a protrusion which projects into a recess in the meter housing leading to the meter connector to assist safety, for example in the event that the insulation creeps back from where it was cut or that too great a length of the conductors was exposed. The known collars also have a radial flange at or adjacent an end of the collar intended to lie adjacent the exposed conductors such that the flange will seat against an outer end of the recess in the meter housing or against a surrounding rim, if provided. However, rather than enhancing safety and security, it is found that flexing of a cable carrying such a collar causes the flange of the collar to lever against a part of the meter housing. By pulling the cable to one side that leverage makes it relatively easy to gain access to the conductors of the cable between the collar or flange and the meter housing.

There is, therefore, a need to provide an improved collar which addresses the issues of both electrical shielding and safety of the conductors of a cable at a connection to an electrical component such as an electricity meter.

Current wiring regulations also require the supply cables to an electricity meter and the feed cables from a meter to a consumer unit, isolator switch or other electrical component to be appropriately identified both by colour and with symbols typically in the form of letters and/or numerals.

The colour may be provided by the colour of the outer sheath of the cable itself, by the use of coloured insulation tape wound around the cable, or by a collar fitted around the cable. In the case of an incoming supply cable to a meter, the live cable should carry a symbol in the form of a single letter L and the neutral cable a single letter N. In the case of a feed cable from a meter, the live cable should carry two letters L and the neutral cable two letters N. Further, in the case of a cable to certain specified items of electrical equipment, the live cable may be required to carry three letters L.

Appropriately coloured self-adhesive tape may be wound around the cables adjacent the connection thereof to an electricity meter. Brown tape may be used for the live cable and blue tape for the neutral cable, in accordance with the European regulations for a single phase supply. Further, the supply cables from the electricity supply to the meter may each carry one band of tape, and the feed cables from the meter to the consumer unit, isolator switch or other electrical component may carry two adjacent, but spaced apart, bands.

Symbols may be provided on the coloured tape, for example the letters L or N. Another possibility is for the symbols to be provided on separate components which are fitted to the cable either before or after the cable is connected to the meter. For example, it is known to use coloured cable ties having the letters marked on the tail of the tie. Once fitted, the cable ties are typically trimmed by cutting away the unwanted part of the tail. Each cable tie or coloured tape will include a band or series of repeated symbols along its length. To mark a cable with a single symbol, such as a single letter L, a single cable tie or strip of tape is wrapped around the electrical cable. To mark a cable with two symbols, such as a double letter L, two cable ties or strips of tape are wrapped around the electrical cable. As such, a single coloured cable tie may be used on an incoming supply cable to a meter and two coloured cable ties on the feed cable from the meter. It will thus be appreciated that six cable ties are required to mark the two incoming and two outgoing cables to an electricity meter, and in the case of a three phase meter twelve cable ties are required. The fitting of these is time-consuming and, of course, an electrician must carry a significant inventory of components in order to be able to adequately mark the cables associated with a meter.

The problem of adequate cable marking for an electricity meter is becoming more acute as there is a programme under way in the UK and elsewhere to replace all existing traditional electricity meters with smart meters. This requires a visit by an operative to each existing meter to check and identify the polarity and phase (in the case of a three-phase electricity supply) of the cables connected to the meter. Once identified, the cables are suitably marked before being disconnected from the meter. The existing meter is then removed and the replacement smart meter mounted in its place, whereafter the cables must be correctly connected to the smart meter. With a simple domestic supply there will be four cables connected to the traditional electricity meter, but with a three phase supply there will be eight such cables, and there may be further cables connected to the meter for example associated with other supply functionality such as a night time tariff. Depending upon when the original meter was installed those cables may carry no identification markings, or may be incompletely or inaccurately marked. As such, following disconnection of the cables from the existing meter, there could be a very high risk of confusion as to which cable is which when reconnecting the cables to the replacement meter unless steps are taken to identify the cables before disconnection from the existing meter and then marking the cables as appropriate.

In an attempt to ensure adequate cable identification for the future, current regulations specify that the cables connected to a new or replacement electricity meter must be appropriately identified, both by colour and symbols to show the function of the cable. These regulations must, therefore, be adhered to on replacing a meter, but the possible confusion of the cables connected to an existing meter must be addressed in order to ensure that, when an existing meter is replaced by a smart meter, the cables are appropriately identified before removal from the existing meter so that the cables are not confused when connected to the connectors of the replacement meter.

It is an aim of this invention to provide a device for attaching to an electrical cable that addresses one or more of the issues described above.

SUMMARY OF THE INVENTION

According to a first aspect of the present invention there is provided an identification tag for attachment to an end of an electrical cable, said cable end having a length of exposed inner conductor beyond an end of a surrounding layer, and the tag comprising:

a collar portion comprising:

- a bore for receiving a part of the cable, the bore extending between first and second ends of the collar portion;
- an abutment surface for limiting the insertion of the cable end through the bore, the abutment surface arranged to engage with the end of the surrounding layer to prevent further insertion of the cable end into the bore when a distal end of the exposed conductor extends from the second end of the bore and a proximal end of the exposed conductor is located within the bore; and
- an outer surface having a profile such that an outer diameter of the collar portion is smaller at the second end than at the first end and the outer diameter of the collar portion decreases gradually from the first end to the second end; and a tab portion connected to and extending from the collar portion, the tab portion including identification means for identifying said cable.

In some embodiments at least a part of the outer surface of the collar portion has a tapered profile. A part of the outer surface of the collar portion may be dome-shaped. In preferred embodiments a part of the outer surface nearest the first end of the collar portion has a cylindrical shape. Typically the profile of the outer surface of the collar portion has three parts, a first part nearest the first end of the collar portion having a cylindrical shape, a second part extending from the first part having a tapered profile and a third part nearest the second end of the collar portion having a tapered profile, an angle of the taper of the third part being greater than an angle of the taper of the second part.

The bore preferably has a first section at the first end of the collar portion having a first diameter and a second section at the second end of the collar portion having a second diameter, the first diameter being larger than the second diameter. The abutment surface may be provided by a shoulder in the bore between the first and second sections. In other embodiments the abutment surface is provided at the first end of the collar portion.

The identification tag preferably comprises attachment means connected to the tab portion, the attachment means being configured to temporarily attach the tag to a cable. Typically the attachment means comprises a clip. The attachment means may comprise a pair of resilient arms extending from the tab portion, the arms being spaced apart to define a gap for receiving said cable. Preferably the resilient arms extend from opposite edges of the tag portion.

So that the identification means are clearly displayed when the tag is attached to a cable the identification means are preferably provided on a first face of the tag portion and the arms extend in a direction opposite to the first face. Each resilient arm may include a projection extending from a distal end region of the arm, each projection extending into said gap.

In some embodiments a distal end section of the tab portion extends beyond the attachment means in a direction away from the collar portion.

The identification means will typically comprise one or more symbols on a surface of the tag portion. The identification means may comprise one or more colours.

Preferably the tag comprises a hinge portion connecting the tab portion to the collar portion, the hinge portion being configured to permit movement of the tab portion relative to the collar portion between a first configuration in which the tab portion extends from the collar portion in a direction transverse to an axis of the collar portion and a second configuration in which the tab portion extends from the collar portion in a direction substantially parallel to the axis, the axis defined by the bore of the collar portion. The hinge portion may include a live hinge. Alternatively the hinge portion comprises a flexible member or element.

The identification tag is preferably made from a plastics material.

According to a second aspect of the present invention there is provided a method of shielding an end of an electrical cable using an identification tag according to the first aspect of the invention, said cable end having a length of exposed inner conductor beyond an end of a surrounding layer, and the method comprising inserting said cable end through the bore of the collar portion from the first end to the second end until the end of the surrounding layer contacts the abutment such that a distal end of the exposed conductor extends from the second end of the bore and a proximal end of the exposed conductor is located within the bore.

Typically, after inserting the cable end through the bore of the collar portion, the distal end of the exposed conductor will be connected to an electrical component. The electrical component may include an aperture in a housing of the component and a recess surface surrounding the aperture. The method therefore preferably comprises inserting the cable end into the aperture and seating the outer surface of the collar portion in contact with the recess surface.

According to a third aspect of the present invention there is provided an assembly comprising:

- a cable including an inner conductor and a surrounding layer, a length of the inner conductor being exposed beyond an end of the surrounding layer at an end of the cable;
- an identification tag according to the first aspect of the invention, the tag being engaged with the end of the cable such that the end of the surrounding layer is in contact with the abutment surface and a length of the exposed conductor extends from the second end of the collar portion; and
- an electrical component including a connector for forming an electrical connection with the conductor of the cable, the cable end being connected to the electrical component such that a part of the outer surface of the collar portion of the tag is in contact with a surface of the electrical component to restrict access to the connector and the exposed conductor.

The electrical component may include an aperture in a housing of the component and a recess surface surrounding the aperture, and a part of the outer surface of the collar portion is preferably seated in contact with the recess surface. The electrical component may be an electricity meter.

In preferred embodiments the identification tag comprises attachment means connected to the tab portion, and the attachment means attach the tab portion to the cable such that the tab portion extends substantially parallel to the cable.

BRIEF DESCRIPTION OF THE DRAWINGS

By way of example only, several specific embodiments of cable safety collar of this invention which also serve as a cable marker will now be described in detail, reference being made to the accompanying drawings, in which.

DETAILED DESCRIPTION

The identification tags for electrical cables of the present invention are intended for use with insulated cables such as are used to make connections to an electricity meter. Such cables are usually referred to as meter tails and typically have conductors of 16 $mm^2$ or 25 $mm^2$ cross-section. The cables have a layer of insulation around the conductors and may also have an outer sheath around the insulation.

Wiring regulations require the cables (tails) connecting an electricity meter to the electricity supply and also the cables connecting the meter to an isolator switch, a consumer unit or another electrical component to be clearly marked for identification purposes. The identification tags described below are intended to be able to perform this function but could be used in other situations besides the wiring of an electricity meter. Furthermore, they may be formed for use with cable sizes other than those referred to in this application.

Figure 1A:
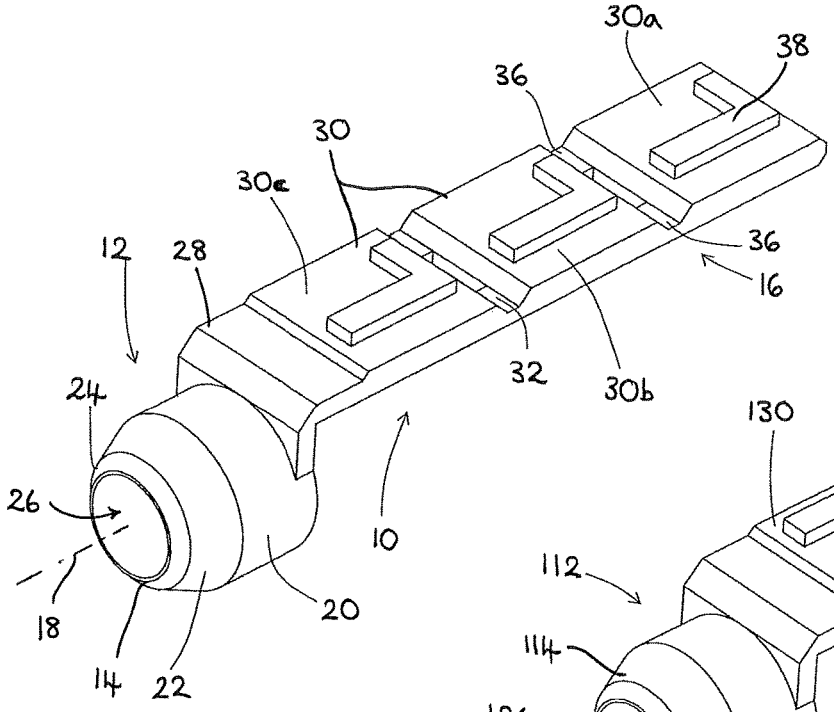
FIGS. 1*a* and 1*b* are isometric views of two identification tags having a collar portion and a tab portion.

FIG. 1*a* shows an identification tag 10 that comprises a collar portion 12 including a tubular socket 14 of circular cross-sectional shape and a tab portion 16 formed integrally with the collar portion 12. The tab portion 16 extends parallel to an axis 18 of the tubular socket 14. The identification tag 10 will typically be made of a plastics material and will generally be injection moulded.

The socket 14 has a first part 20 of uniform outer diameter, a second part 22 of a generally conical form and a third part 24 also of a conical form but with a greater conical angle than that of the second part 22. As shown, the three parts 20, 22, 24 are distinct but could blend one into another with a smooth transition, or could be more rounded and so essentially of part-spherical form. Internally, the socket 14 has a bore 26 of two diameters with a step or shoulder therebetween. A first portion of the bore 26 having a larger diameter is within the cylindrical first part 20 of the socket 14, and a second portion of the bore 26 having a smaller diameter extends through the second and third parts 22, 24 of the socket 14.

The tab portion 16 is connected to the first part 20 of the socket 14 by a bridging portion 28 and is moulded so as to extend from the first part 20 of the socket 14 in a direction away from the second and third parts 22, 24 of the socket 14. The tab portion 16 is of a generally rectangular planar shape. The tab portion 16 is divided into three sections 30 by separation zones 32 configured such that it is possible to fully separate the sections 30. In particular, in this example, it may be possible manually to break away or snap off a free end section 30*a* furthest from the collar portion 12 from the other two sections 30*b*, 30*c* or the free end section 30*a* and the next adjacent section 30*b* leaving one section 30*c* connected to the collar portion 12. To assist this, the separation zone 32 may be weakened for example by including a transverse slot 34 therethrough such that the free end section 30*a* is connected to the next adjacent section 30*b* by two small, spaced apart ribs 36. In the alternative, the separation zones 32 may be cut or otherwise severed as required by using a suitable tool to remove one or more sections 30 from the identification tag 10—for example by using scissors or side cutters, which form a part of every electrician's kit, or by using another suitable tool.

Each section 30 of the tab portion 16 carries symbols 38 typically in the form of letters and/or numerals which act as identification means to identify the cable to which the identification tag 10 is fitted. In the case of the embodiment of FIG. 1*a*, each section 30 carries an embossed letter L (i.e. the tab portion 16 is moulded so that the letter upstands from a surface of the tab portion 16) such that if no section 30 is removed, the identification tag 10 will show three letters L. If one section 30 is removed the tag 10 will show two letters L, and if two sections 30 are removed then the tag 10 will show a single letter L. Further, though not shown in the drawings, the identification tag 10 is moulded from a brown plastic material, being the European wiring colour for a live electricity cable.

Figure 1B:
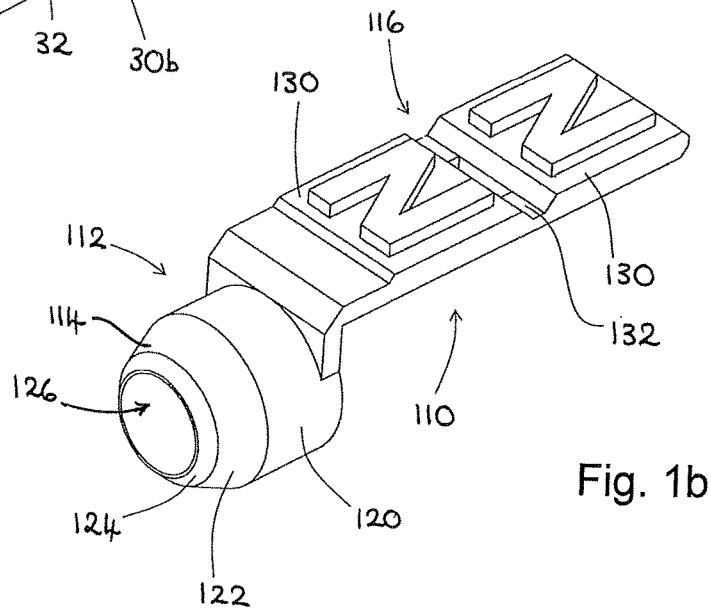

The example of an identification tag 110 shown in FIG. 1*b* is essentially the same as that of FIG. 1*a* but differs in that only two sections 130 are provided in a tab portion 116 with a separation zone 132 therebetween. In this way, a free end section 130*a* may be broken away, snapped off or otherwise cut off to leave only one section 130*b* connected to a socket 114 of the identification tag 110. Each of the sections 130 carries an embossed letter N (i.e. the tab portion 116 is moulded so that the letter upstands from a surface of the tab portion 116) such that if the end section 130*a* is not removed, the identification tag 110 will show two letters N, but if the end section 130*a* is removed then the tag 110 will show a single letter N. Further, though not shown in the drawings, the identification tag 110 is moulded from a blue plastic material, being the European wiring colour for a neutral electricity cable.

Figure 2A:
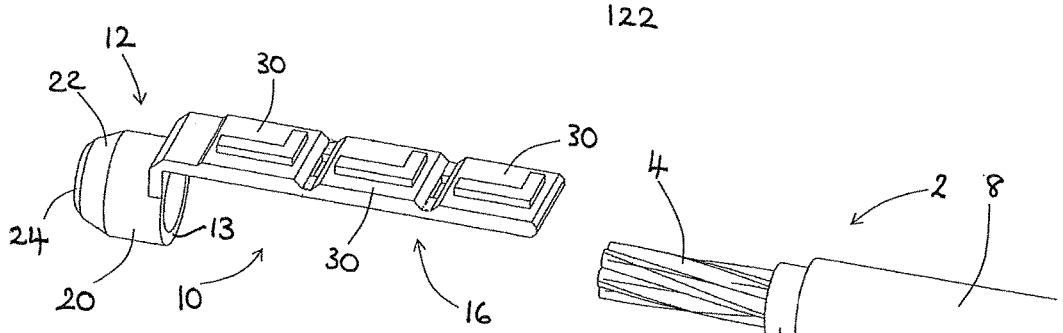
FIGS. 2*a* and 2*b* show the identification tags of FIGS. 1*a* and 1*b* being fitted to prepared cable ends.
Figure 2B:
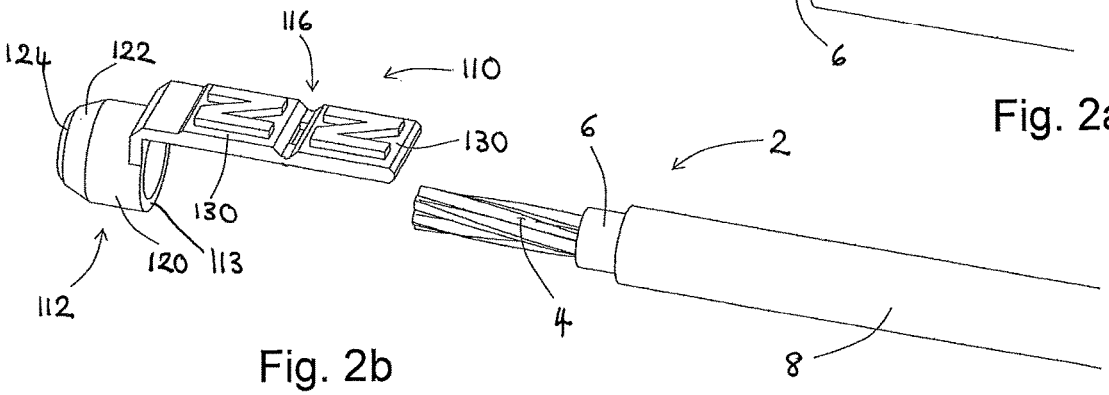

FIGS. 2*a* and 2*b* show the identification tags 10, 110 of FIGS. 1*a* and 1*b* respectively about to be fitted to a pair of prepared cable ends (meter tails) 2 having conductors 4 typically of 25 $mm^2$ or 16 $mm^2$ cross-sectional area. A layer of insulation 6 surrounds the inner conductors 4 and an outer sheath 8 overlays or surrounds the insulation layer 6. The cable ends 2 are prepared by performing a so-called two-level strip, preferably with a tool especially adapted for the purpose, such that a pre-defined length of the conductors 4 is exposed beyond the insulation layer 6 and a shorter length of the insulation layer 6 is exposed beyond the outer sheath 8. The identification tags 10, 110 of FIGS. 1*a* and 1*b* are fitted to the cables 2 by inserting and passing the conductors 4 through the bore 26, 126 in the socket 14, 114. In the case of a 25 $mm^2$ cable, a cut end 9 of the outer sheath 8 engages an end face 13, 113 of the socket 14, 114 and the insulation layer 6 is located within the larger diameter bore within the first part 20, 120 of the socket 14, 114. The conductors 4 extend through the second and third parts 22, 24, 122, 124 of the socket 14, 114 and project out of and beyond the third part 24, 124 of the socket 14, 114. In the case of a 16 $mm^2$ cable, the cut end 9 of the outer sheath 8 engages the shoulder between the larger and smaller diameter bores in the socket 14, 114 and the insulation layer 6 is located within the smaller diameter bore. The conductors 4 project beyond the third part 24, 124 of the socket 14, 114.

Figure 3A:
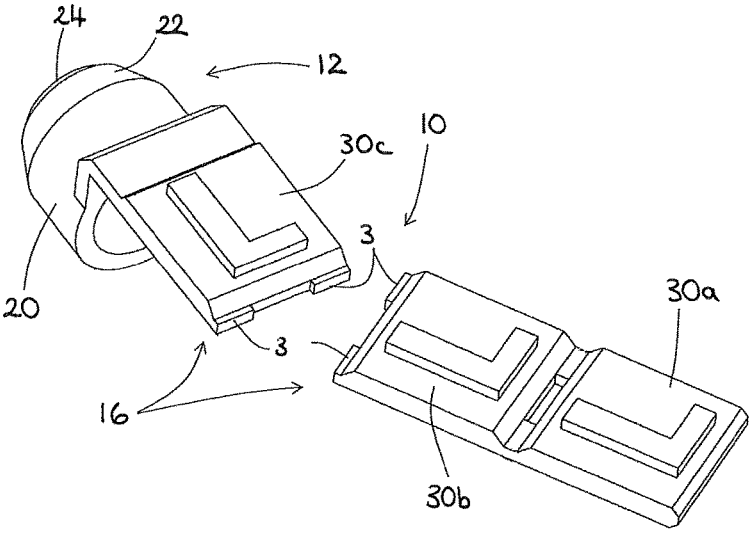
FIGS. 3*a* and 3*b* show severing of the tab portion of each of the identification tags of FIGS. 1*a* and 1*b*, for different applications.
Figure 3B:
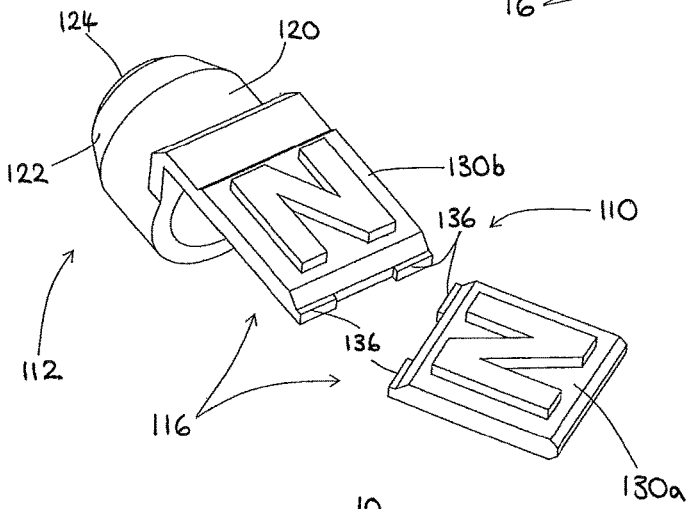
Figure 4A:
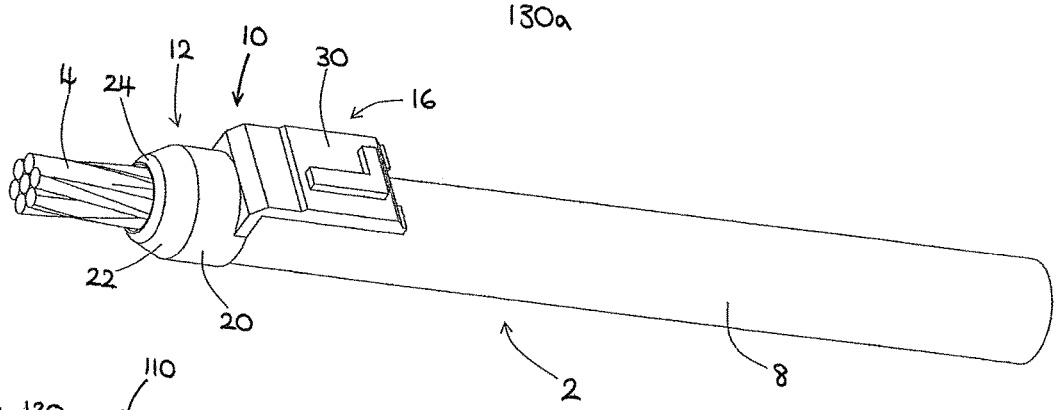
FIGS. 4*a* and 4*b* show the severed identification tags of FIGS. 3*a* and 3*b* fitted to prepared cable ends.
Figure 4B:
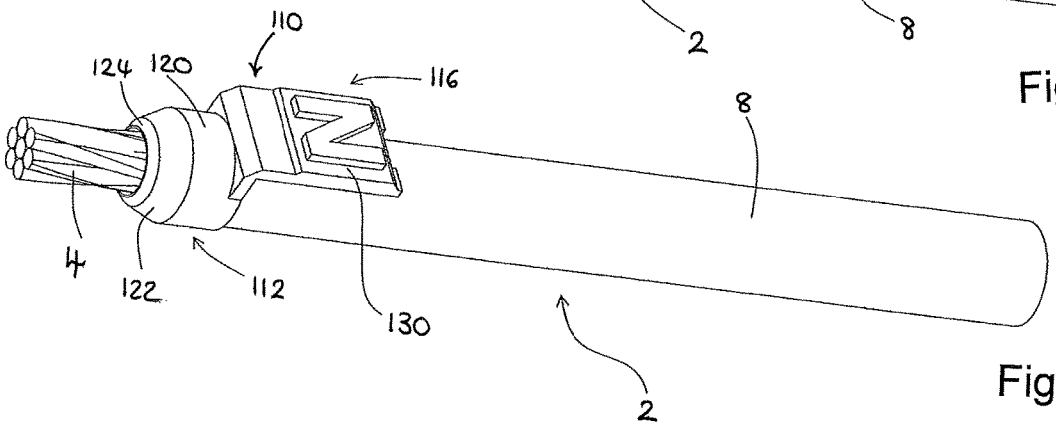

FIGS. 3*a* and 3*b* show the preparation of identification tags 10, 110 to be attached to the live and neutral supply cables for an electricity meter respectively. Such cables are to be marked with a single letter L or N as appropriate and so the two excess letters L are removed from the identification tag 10 of FIG. 1*a* and the one excess letter N is removed from the identification tag 110 of FIG. 1*b*. The identification tags 10, 110 are then fitted to the appropriate cables 2 as described with reference to FIGS. 2*a* and 2*b*, to obtain the appropriately identified cables 2, as shown in FIGS. 4*a* and 4*b*.

Figure 5:
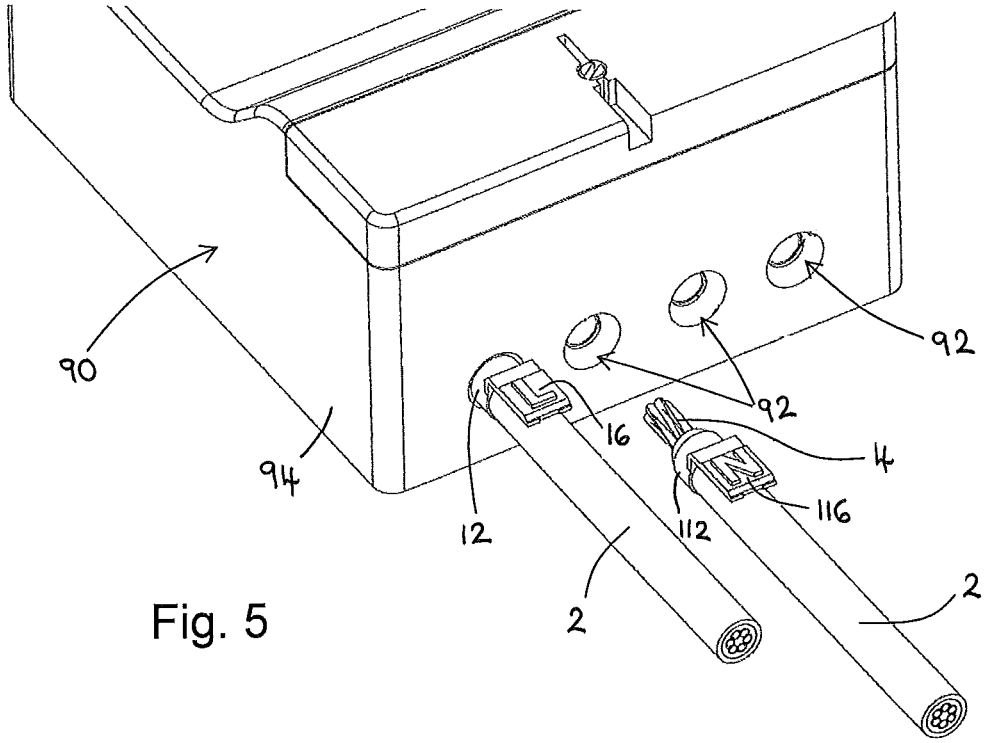
FIG. 5 shows the cables of FIGS. 4*a* and 4*b* carrying the identification tags of FIGS. 3*a* and 3*b* being fitted to an electrical component such as an electricity meter.
Figure 6:
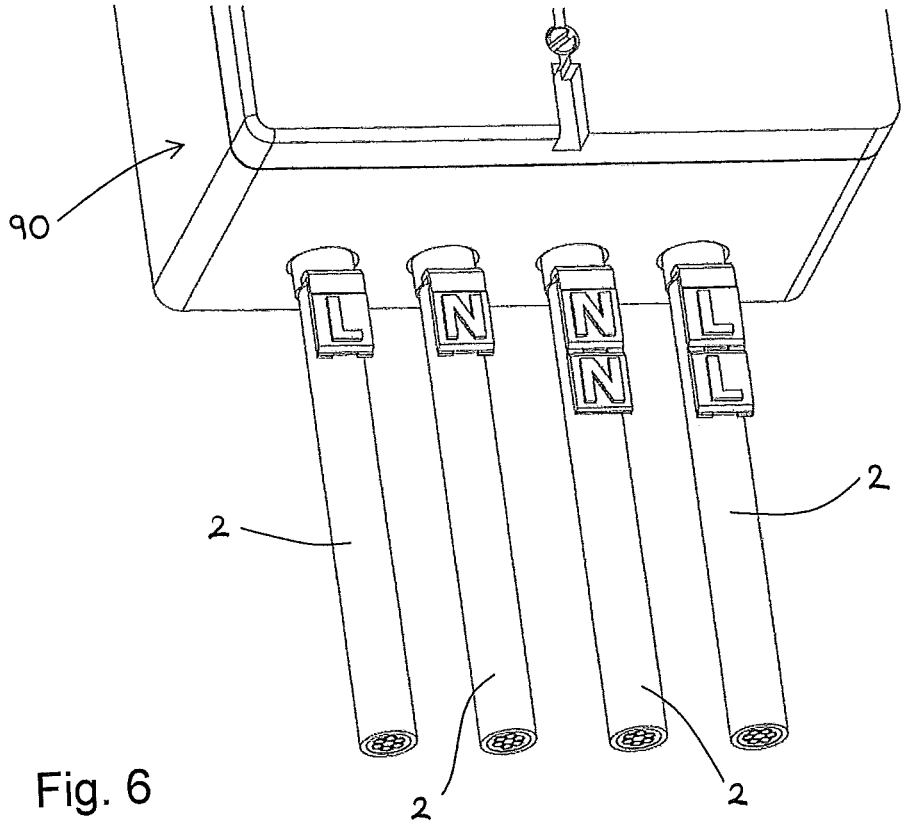
FIG. 6 shows the electricity meter of FIG. 5 with both input and output cables fitted thereto.

Once the identification tags 10,110 have been attached to the ends of the cables 2, the cables 2 are connected to an electricity meter 90 such as that shown diagrammatically in FIGS. 5 and 6. Such a meter 90 typically has internal brass connectors fitted with screw clamps (not shown) to effect a mechanical and electrical connection to the conductors 4 of the cables 2. The connectors are generally located at the inner ends of generally conical or stepped recesses 92 in the housing 94 of the meter 90. The collar portion 12, 112 of the identification tag 10, 110 is configured such that the outer diameter of the first part 20, 120 of the socket 14, 114 is smaller than the entrance to a recess 92 and the configuration and dimensions of the second and third parts 22, 24, 122, 124 are such that these fit deeper within a recess 92, almost up to the connector therewithin, as shown in FIG. 7 and described further below.

FIG. 6 shows the meter 90 of FIG. 5 but with the live and neutral supply cables 2 appropriately marked with identification tags 10, 110 and connected to the meter 90, and the live and neutral feed cables 2 appropriately marked with identification tags 10, 110 and leading from the meter 90 to a consumer unit, isolator switch or other electrical component (not shown). It can be seen that the live and neutral supply cables 2 have been engaged with an identification tag 10, 110 having identification means including a single letter L and a single letter N respectively, and the live and neutral feed cables 2 have been engaged with an identification tag 10, 110 having identification means including a double letter L and a double letter N respectively.

Figure 7:
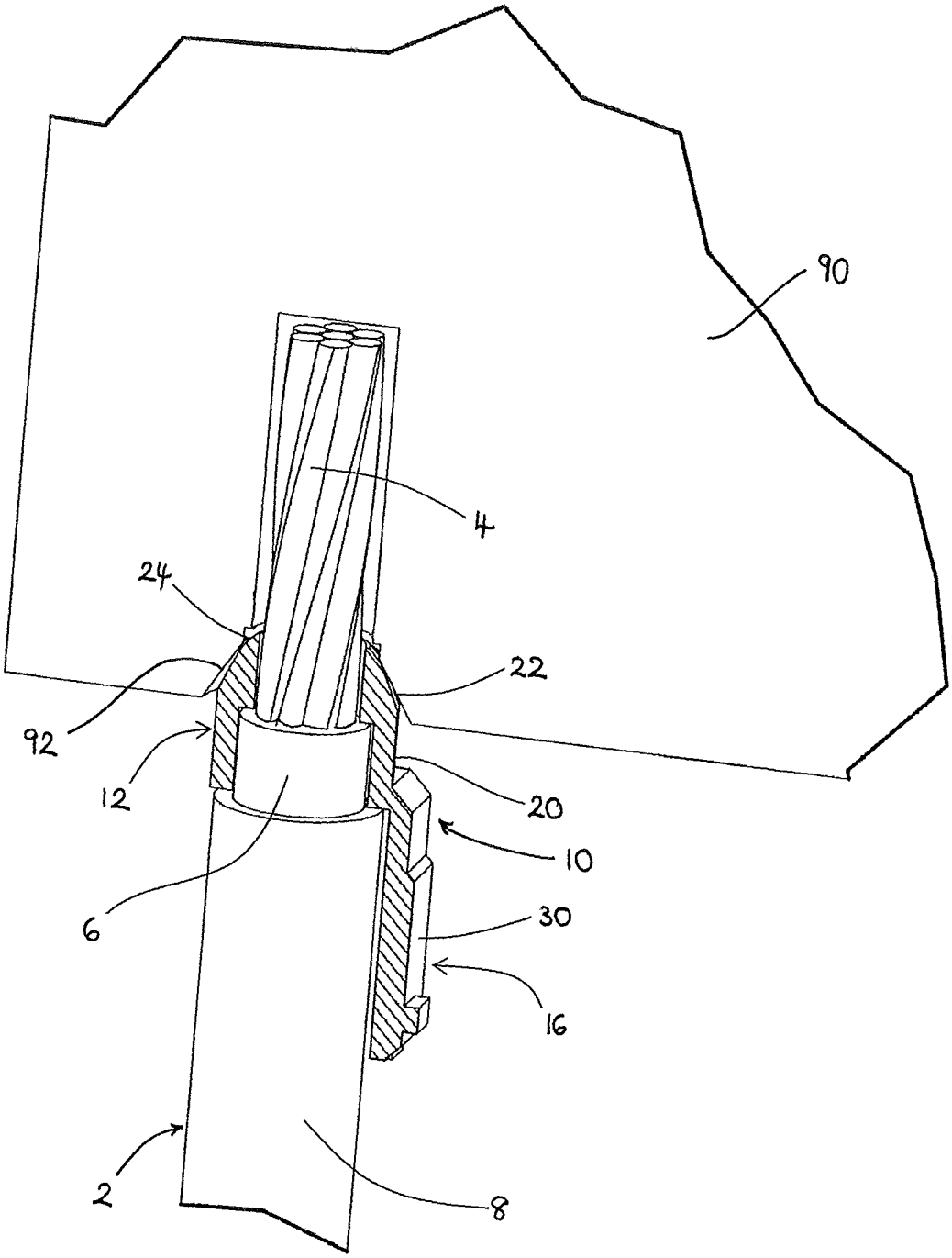
FIG. 7 is a partial cross-sectional view through a cable carrying an identification tag as shown in FIG. 4*a* or 4*b* and fitted to an electricity meter.

FIG. 7 is a partial cross-sectional view of one of the supply connections to the meter 90. As can be seen, the second and third parts 22, 24 of the socket 14 fit closely in the recess 92 of the meter 90. The interface formed in this way prevents access to the conductors 4 or to the connector of the meter 90. If the cable 2 is mechanically flexed, that will cause the external profile of the collar portion 12 to move in engagement with the recess 92 and lessen or reduce the likelihood of access to the conductors 4 of the cable 2 or the connector of the meter 90. This protection is enhanced because the collar portion 12 is typically made of a tougher or harder grade of plastics material than the insulation 6 or sheath 8 of the cable 2. Further, and as can be seen in FIG. 7, the collar portion 12 prevents access to the conductors 4 of the cable 2 at or closely adjacent a cut end 7 of the insulation layer 6. Thus, the identification tag 10 serves to provide electrical isolation of the electricity-carrying components and reduces the possibility of unauthorised access to those components, as well as serving to identify the cables 2.

Figure 8A:
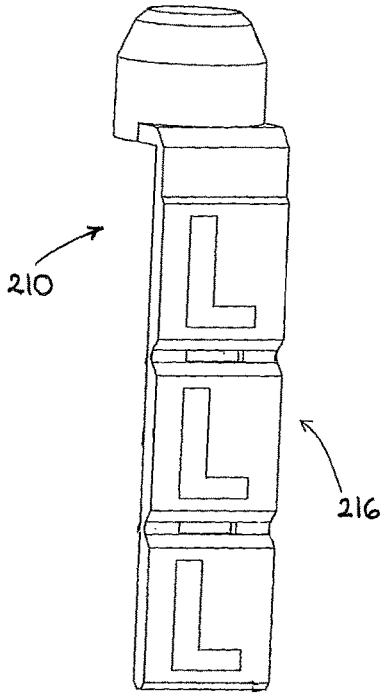
FIGS. 8*a*, 8*b* and 8*c* show three identification tags including distinguishing means on the tab portions, the distinguishing means produced by different techniques.
Figure 8B:
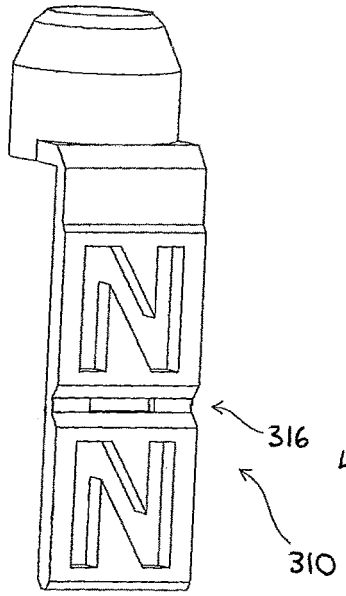

FIGS. 8*a* and 8*b* show two different ways in which the symbols L and N may be provided on a tab portion 216, 316 of an identification tag 210, 310. With the embodiment of FIG. 8*a*, the letters L are produced by a change in surface texture on the tab portion 216. The majority of the surface area of the tab portion 216 may be relatively smooth and the letters L may be moulded to have a relatively matt or rough texture, which may be printed or otherwise coloured so as clearly to identify a cable carrying the identification tag 210. FIG. 8*b* shows the letters N formed by piercing through the tab portion 316 such that the colour of the cable to which the identification tag 310 is fitted may be seen through those pierced letters. Another possibility would be to have the letters formed by moulded depressions in the tab portion, as distinct from being moulded to upstand from the tab portion as shown in the previous embodiments.

Figure 8C:
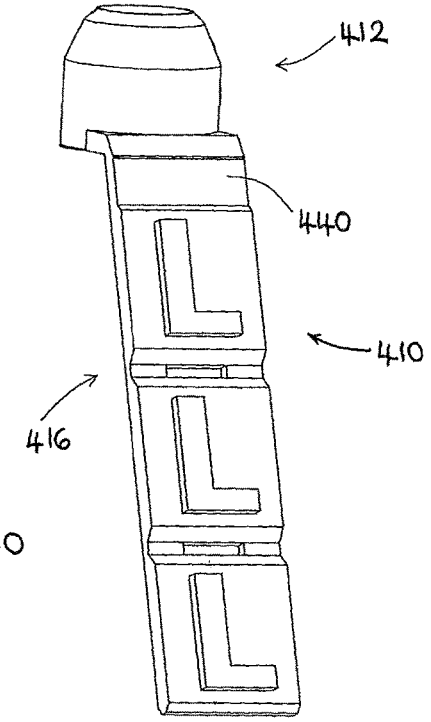

In the embodiment of FIG. 8*c*, the tab portion 416 is moulded to extend away from the collar portion 412 at an angle to the axis thereof, with a relatively flexible zone 440 connecting the tab portion 416 to the collar portion 412. Such an identification tag 410 may be used in an area where visibility is restricted as the tab portion 416 may be flexed to lie at a convenient angle to the length of the cable, to enhance the visibility of the identification.

Figure 9:
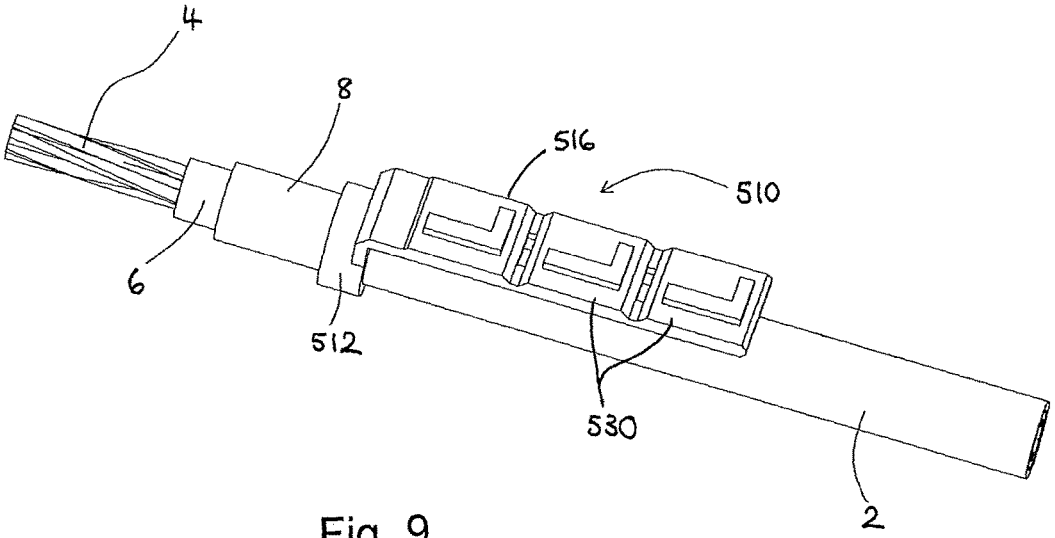
FIG. 9 shows an identification tag attached to a cable, the tag having a collar portion and a tab portion.

FIG. 9 shows another identification tag 510, generally similar to that of FIG. 1 but in this case the identification tag 510 has a simple collar portion 512 having an annular shape. The collar portion 512 includes a bore of a single diameter arranged to be a light frictional fit on the sheath 8 of a cable 2. A tab portion 516 extends from the collar portion 512 in a similar manner to that described above in relation to the earlier examples. As shown, the identification tag 510 may be positioned remote from the prepared end of a cable 2 and so may be used in conjunction with an identification tag 10 such as shown for example in FIG. 1*a*, to give improved identification of a cable 2, i.e. the cable 2 may include identification tags 10, 510 in two places along its length.

As with the previous embodiments, one or two sections 530 of the tab portion 516 may be divided, separated or removed prior to fitting the identification tag 510 to a cable 2, so that the identification tag 510 displays fewer symbols. Further, the identification tag 510 may be supplied with other symbols besides those shown in the drawings, or other numbers of sections 530 each carrying one or more symbols, besides those shown in FIG. 9.

Figure 10:
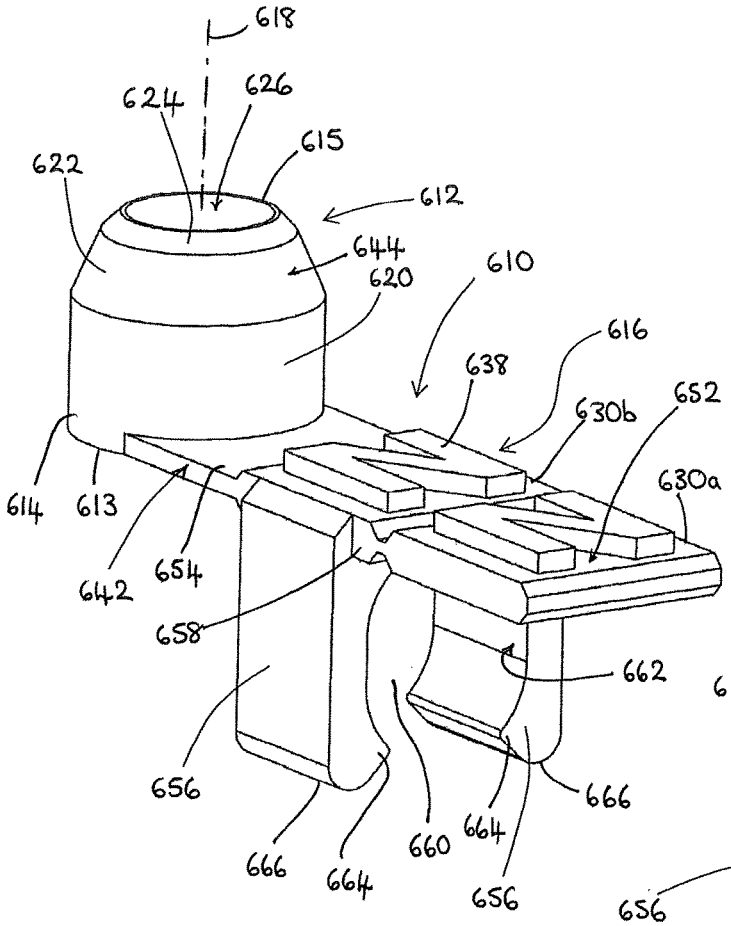
FIG. 10 shows an identification tag according to an embodiment of the present invention, the tag having a hinge region between a collar portion and a tab portion, and the tag being in a first configuration before attachment to a cable.
Figure 11:
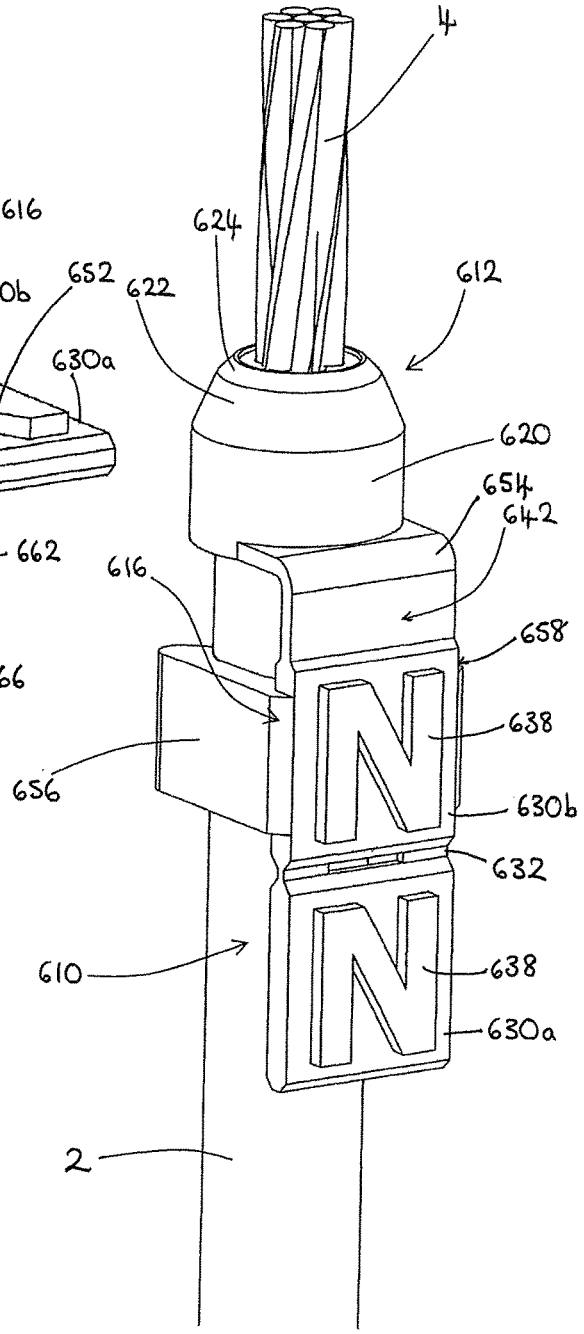
FIG. 11 shows the identification tag of FIG. 10 in a second configuration and attached to an end of a cable.

FIGS. 10 and 11 show an identification tag 610 according to a first preferred embodiment of the present invention. The identification tag 610 comprises a collar portion 612 and a tab portion 616. The tab portion 616 is connected to the collar portion 612 by a hinge portion 642 or flexible connecting portion. Typically the identification tag 610 will be a unitary element such that the collar portion 612, tab portion 616 and connecting portion 642 are integrally formed. Furthermore, the identification tag 610 will typically be injection moulded from a suitable plastics material.

The collar portion 612 comprises a generally tubular socket 614 having a central bore 626. The bore 626 extends fully through the socket 614 between first and second ends 613, 615 of the socket 614, thereby defining an axis 618 of the collar portion 612.

In this embodiment the socket 614 has three parts 620, 622, 624 defined by the profile of an outer surface 644 of the collar portion 612. A first part 620 extending from the first end 613 of the socket 614 has a cylindrical outer surface so that an outer diameter of the first part 620 is constant. A second part 622 of the socket 614 extends from the first part 620 and has a tapered or conical outer surface. In this way an outer diameter of the second part 622 furthest from the first part 620 is smaller than the outer diameter of the first part 620. A third part 624 of the socket 614 extends from the second part 622 and has a tapered or conical outer surface. In this way an outer diameter of the third part 624 at the second end 615 of the socket 614 furthest from the second part 622 is smaller than the outer diameter of a section of the second part 622.

It will be appreciated that although the socket 614 of this embodiment has been described as having three distinct parts 620, 622, 624, in other embodiments the socket 614 may have a curved outer surface 644 such that there is a smooth transition between each of the first, second and third parts 620, 622, 624. Furthermore, in some embodiments the outer surface 644 of the socket 614 may be substantially dome-shaped. Importantly an outer diameter of the socket 614 is smaller at the second end 615 of the socket 614 than at the first end 613, and the outer diameter of the socket 614 increases gradually between the second and first ends 613, 615. In particular the outer surface 644 of the socket 614 does not include a distinct step or sharp change in diameter, but has a gradual and substantially continuous decrease in diameter from the first end 613 to the second end 615, thereby creating a generally tapered collar portion 612.

Figure 12:
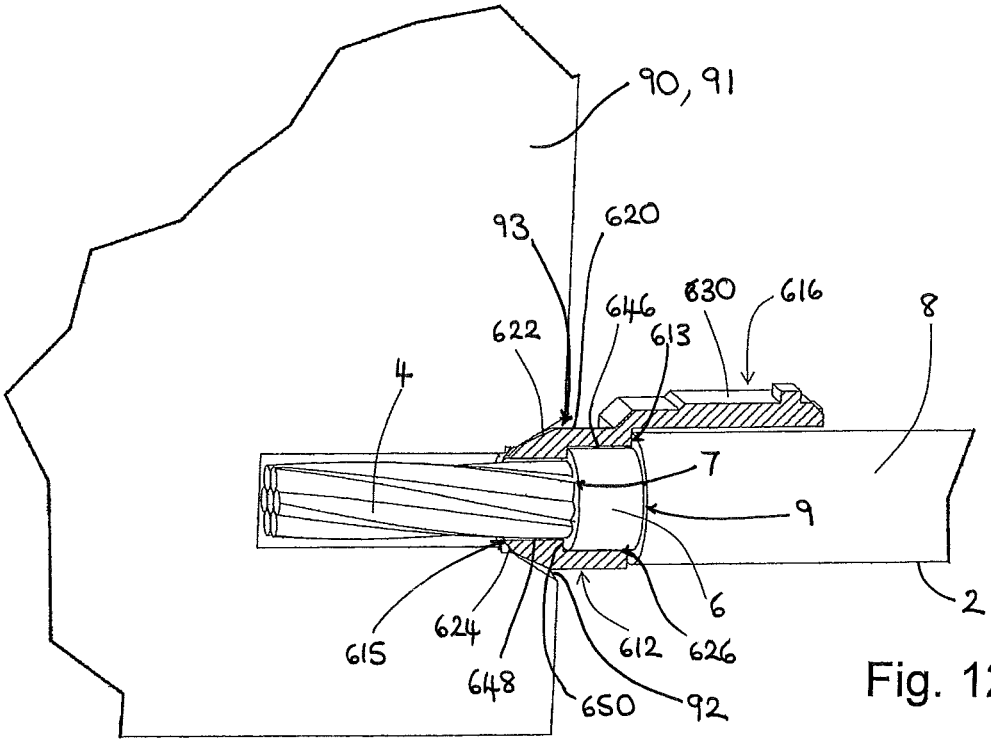
FIG. 12 is a partial cross-sectional view of an identification tag having a collar portion and a tab portion according to the invention.

With reference to FIG. 12, the bore 626 through the socket 614 has a first portion 646 having a first, larger diameter and a second portion 648 having a second, smaller diameter. The first portion 646 of the bore 626 extends from the first end 613 of the socket 614 and the second portion 648 of the bore 626 extends from the second end 615 of the socket 614. A shoulder 650 is formed between the first and second portions 646, 648 of the bore 626.

In the embodiment of the identification tag 610 of FIG. 10, the tab portion 616 comprises a first section 630*a* and a second section 630*b*. The second section 630*b* is connected to the hinge portion 642 and the first section 630*a* is connected to the second section 630*b* by a separation portion or zone 632. In this way the first and second sections 630*a*, 630*b* of the tab portion 616 extend linearly from the hinge portion 642. Each of the first and second sections 630*a*, 630*b* comprises identification means in the form of a symbol 638 provided on a first surface 652 of the tab portion 616.

The separation portion 632 comprises a thinner region of material such that the tab portion 616 may be more easily broken in this region. This allows a user to easily separate the first section 630*a* from the second section 630*b* and the rest of the identification tag 610, as described above in relation to the earlier examples.

The hinge portion 642 is movable between a first configuration, shown in FIG. 10, and a second configuration, shown in FIG. 11. In the first configuration the hinge portion 642 is arranged such that the tab portion 616 extends transverse to the axis 618 of the collar portion 612. In other words the tab portion 616 extends radially outwards from the socket 614. In the second configuration the hinge portion 642 is arranged such that the tab portion 616 extends substantially parallel to the axis 618 of the collar portion 612. In other words the tab portion 616 extends axially from the socket 614.

In this embodiment the hinge portion 642 comprises a flexible member 654 that is connected to the socket 614 proximate the first end 613 of the socket 614. In particular the flexible member 654 extends from an outer surface 644 of the first part 620 of the socket 614. In the first configuration the flexible member 654 is substantially planar and in the second configuration the flexible member 654 is bent through about 90° proximate the socket 614.

The tab portion 616 of the identification tag 610 further comprises attachment means in the form of a pair of resilient arms 656. A first arm 656 extends from a first edge 658 of the tab portion 616 and a second arm 656 extends from an opposite, second edge 658 of the tab portion 616. The first and second arms 656 extend from the tab portion 616 in a direction substantially transverse to the tab portion 616. Furthermore, the first and second arms 656 extend in substantially the same direction from the tab portion 616 such that a gap 660 is defined between inner surfaces 662 of the first and second arms 656. A barb or hook portion 664 extends from a distal end 666 of each of the arms 656. Each of the barbs 664 extends into the gap 660, such that the barb 664 on the first arm 656 extends substantially towards the second arm 656 and the barb 664 on the second arm 656 extends substantially towards the first arm 656.

The gap 660 between the arms 656 is sized to receive an electrical cable 2 to which the identification tag 610 is to be attached. The arms 656 are configured to be releasably engaged with a cable 2 so that the identification tag 610 can be easily and quickly clipped onto and removed from a cable 2 during use. Once the identification tag 610 has been clipped onto the cable 2 the barbs 664 of the arms 656 resist withdrawal or removal of the identification tag 610 from the cable 2, thereby retaining the identification tag 610 on the cable 2; however, the resilience of the arms 656 allows a user to pull the identification tag 610 off the cable 2 by application of suitable force to cause the arms 656 to flex outwardly to disengage the barbs 664 from the cable 2.

The arms 656 extend from the second section 630*b* of the tab portion 616 in a direction opposite to the first surface 652 of the tab portion 616. In the first configuration of the identification tag 610 the first and second arms 656 extend from the tab portion 616 in an opposite direction to the socket 614. In the second configuration of the identification tag 610 the gap 660 between the first and second arms 656 is axially aligned with the bore 626 through the socket 614.

The identification tag 610 includes a single clip comprising the first and second arms 656, and this clip extends from the second section 630*b* of the tab portion 616. This enables a user to remove the first section 630*a* of the tab portion 616 if only one section and, therefore, one identification symbol is required.

The identification tag 610 will typically be manufactured in the first configuration and during use of the identification tag 610 a user will move the identification tag 610 into the second configuration. Use of the identification tag 610 will now be described with reference to FIGS. 16 to 19.

Figure 16:
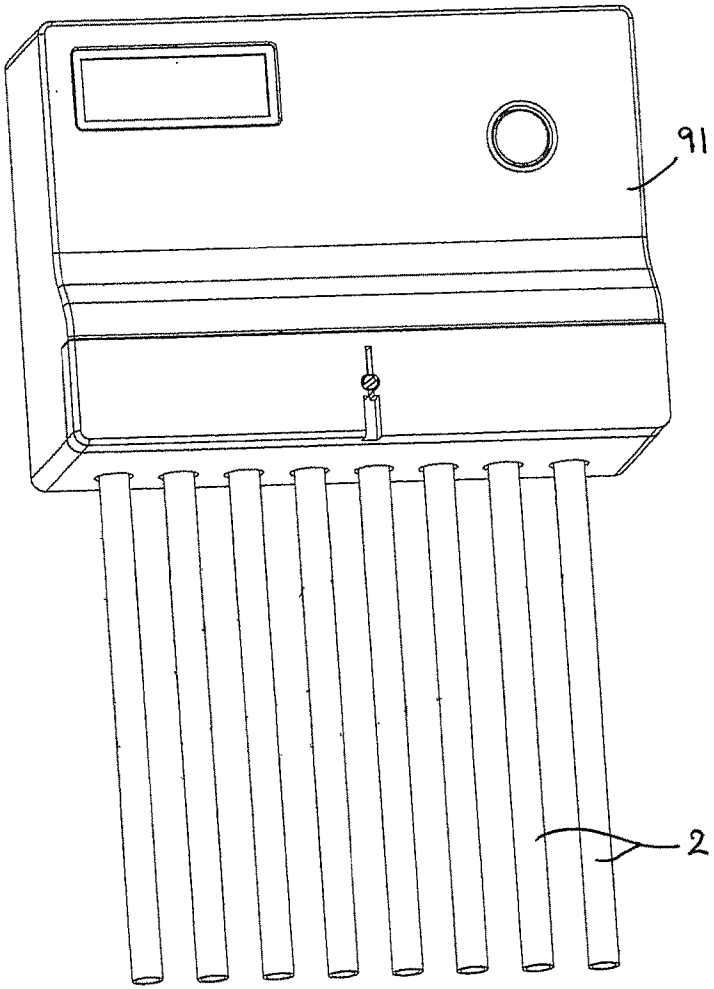
FIG. 16 shows a three phase electricity meter having eight cables connected thereto.

FIG. 16 shows a typical three phase electricity meter 91, as installed in premises for the metering of three phase electricity supplied to those premises. Thus, the meter 91 has connected to it three incoming (supply) three phase live cables, three outgoing (feed) three phase live cables, one incoming (supply) neutral cable and one outgoing (feed) neutral cable. These cables 2 are typically referred to as "tails" or "meter tails" in the electrical installation field.

For relatively low power installations the conductors 4 of the tails will be of either 16 $mm^2$ cross-sectional area or 25 $mm^2$ cross-sectional area. Sometimes, 16 $mm^2$ cross-sectional cables 2 have one layer of insulation 6 surrounding the conductors 4 whereas 25 $mm^2$ cables have one layer of insulation 6 surrounding the conductors and an outer sheath 8 around the layer of insulation 6. The following description will primarily be concerned with cables 2 having both a layer of insulation 6 and an outer sheath 8, but is not limited to conductors 4 having a cross-sectional area of 25 $mm^2$.

In a typical installation the cables 2 connected to the meter 91 may not be clearly identified, even if they were when the cables 2 were installed, perhaps several years previously. However, from the wiring diagrams usually provided with electricity meters it should be apparent to an electrical technician which cables are which. Even if the cables 2 or the meter 91 are not so marked, it is possible to use appropriate test equipment to determine which cables 2 are which—that is, which cable is the live feed from the supply to the meter, which is the live feed from the meter to an isolator switch or a consumer unit, and which are the corresponding neutral cables. With a three-phase meter 91, there will be six live cables 2 to be identified—three incoming and three outgoing—as well as the two neutral cables 2. When the meter 91 is to be changed the electricity supply to the meter 91 must be turned off and all of the cables 2 must be disconnected from the meter 91. In order to prevent confusion as to which cable is which, it is essential that the cables 2 are somehow identified before disconnection of those cables 2 from the existing meter 91 and the removal thereof.

In accordance with a method of this invention, all of the cables 2 connected to the meter 91 are identified as a first step and then are temporarily pre-marked with identification tags 610 before the disconnection of those cables 2 from the existing meter 91. As described above, each identification tag 610 has a collar portion 612 for fitting on to a cable end 2, once stripped to expose the conductors 4, and a tab portion 616 extending away from the collar portion 612. As manufactured, the identification tag 610 may carry two essentially identical symbols 638 arranged serially along the length of the tab portion 616 with a separation region or weakened zone 632 between the sections 630 carrying the symbols 638. On a face of the tab portion 616 opposed to the symbol 638 nearer the collar portion 612, there is a pair of arms 656 of a suitable configuration for clipping on to a cable 2 with which the identification tag 610 is to be used. In addition to the symbols 638 discussed above, the identification tags 610 are coloured—typically by being moulded from suitably coloured plastic material. In the UK, all markers for live cables are coloured brown, but within most other countries of the EU, different colours are used for the different phases of the live conductors and so the identification tags 610 should be correspondingly coloured.

Figure 17:
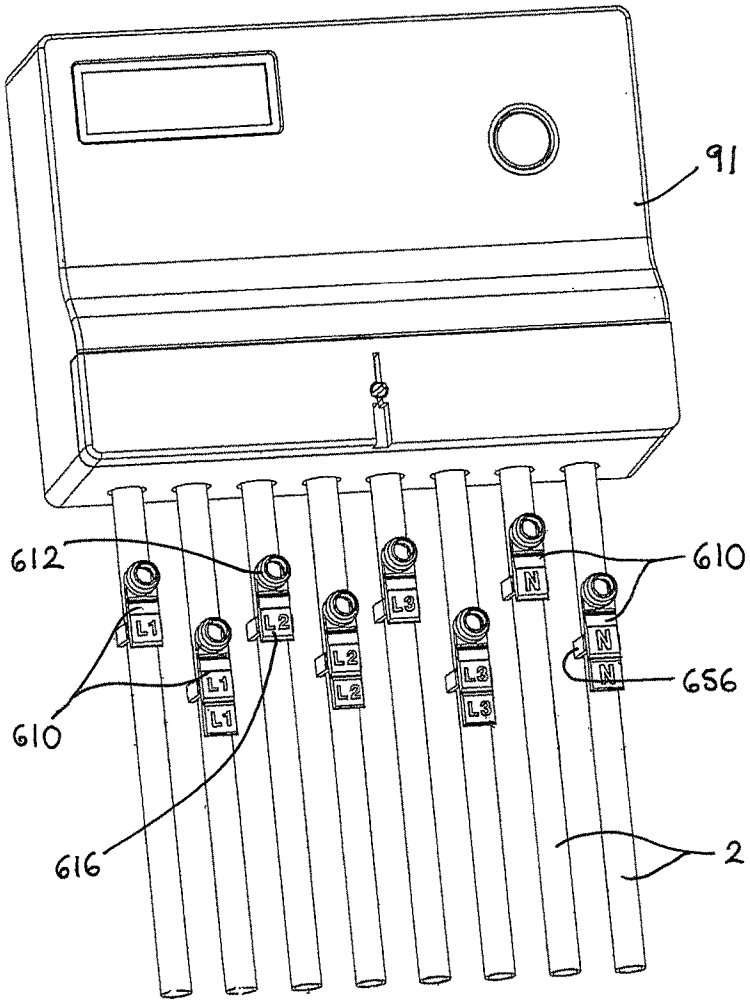
FIG. 17 shows the meter and cables of FIG. 16, the cables being pre-marked in a temporary manner with individual identification tags according to the present invention, the tags being in a first configuration.

In a first step in the method each of the cables 2 connected to the electricity meter 91 is identified. A user then selects the appropriate identification tag 610 for each cable 2. With the identification tag 610 in the first configuration the user clips the appropriate identification tag 610 onto the cable 2 at a distance from the end of the cable 2 and, therefore, at a distance from the meter 91, as shown in FIG. 17. As described above, the identification tags 610 are clipped to the cables 2 by the attachment means which comprises resilient arms 656 that engage around the cable 2. The barbs 664 provided at the distal ends 666 of the arms 656 retain the identification tags 610 securely on the cables 2.

The table below shows a selection of identification tags that may be used to pre-mark the cables connected to the electricity meter.

| Cable | Identification tag symbols | UK colours | EU colours |
|---|---|---|---|
| Incoming Phase 1 | L1 | Brown | Brown |
| Outgoing Phase 1 | L1 L1 | Brown | Brown |
| Incoming Phase 2 | L2 | Brown | Black |
| Outgoing Phase 2 | L2 L2 | Brown | Black |
| Incoming Phase 3 | L3 | Brown | Grey |
| Outgoing Phase 3 | L3 L3 | Brown | Grey |
| Incoming Neutral | N | Blue | Blue |
| Outgoing Neutral | N N | Blue | Blue |

When clipped on to the cables 2 in this first configuration, each identification tag 610 has the axis 618 of the collar portion 612 extending in a generally radial direction with respect to the cable 2 and with the tab portion 616 lying in a plane substantially parallel to an axis of the cable 2. The attachment of the identification tag 610 is only temporary by virtue of the arms 656, but is sufficiently secure to allow disconnection of the cables 2 from the meter 91 without loss of the identification tags 610 identifying the cables 2 for subsequent reconnection to a replacement meter 91.

Figure 18:
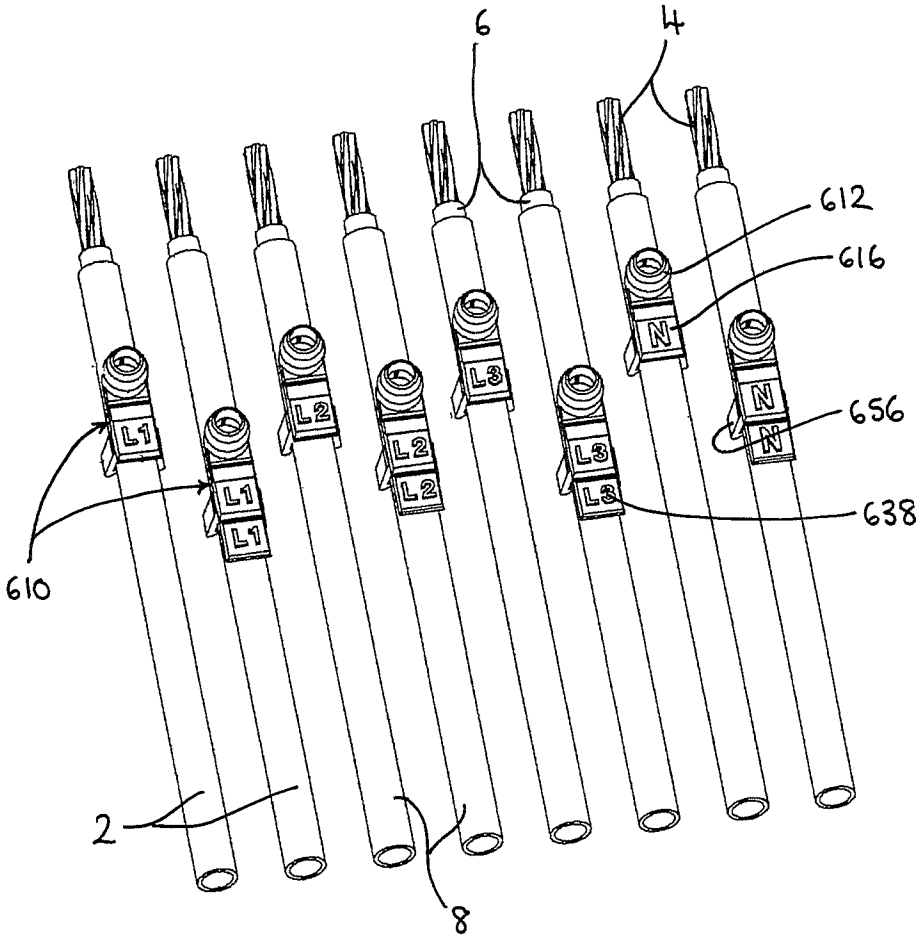
FIG. 18 shows the eight cables disconnected from the electricity meter, which has been removed for exchange purposes, each cable having a conducting core, a layer of insulation around the core and an outer sheath around the layer of insulation.

When all of the cables 2 have been disconnected from the meter, as shown in FIG. 18, the meter is released from a mounting surface and set aside. In all likelihood, the exposed conductors 4 of the cables 2 will to some extent have been damaged by the termination screws of the connector within the meter and so in this example of the method of this invention, all of the exposed used conductors 4 and perhaps a length of the surrounding insulation 6 and sheath 8 are cut away to give a clean end to the cable 2. A two-level strip is then performed on each cable end 2, preferably using a tool especially configured for this purpose as known in the art, so as to expose a defined length of the conductors 4 and a second defined length of insulation 6, as shown in FIG. 18. Alternatively, for some applications it may be sufficient to perform a single level strip.

Throughout this process, and while the cables 2 are removed from the meter 91, the identification tags 610 remain attached to each of the cables 2 allowing subsequent and continued identification of the cables 2.

Once the ends of the cables 2 have been satisfactorily prepared, the cables 2 may be connected to the replacement meter 91.

Taking each cable 2 in turn, the identification tag 610 clipped onto the cable 2 is released from the cable 2, either by pulling the identification tag 610 radially off the cable 2 or by sliding the identification tag 610 axially along the cable 2 and off the cable end. The end of the cable 2 is then inserted into the collar portion 612 of the identification tag 610, as shown in FIG. 11.

The cable end 2 is preferably inserted through the bore 626 of the socket 614 until the layer of insulation 6 contacts the shoulder 650 of the bore 626. In this position the outer sheath 8 of the cable 2 (when present) preferably contacts the first end 613 of the socket 614, as illustrated in FIG. 12. It will be appreciated that, in embodiments in which the cable 2 does not include an outer sheath 8, the layer of insulation 6 will still abut the shoulder 650 of the bore 626. In this way, regardless of the dimensions of the cable 2 and the presence or otherwise of the sheath 8, the insulation 6 extends into the first portion 646 of the bore 626 so that the cut end 7 of the insulation 6 is surrounded and covered by the collar portion 612 of the identification tag 610.

As can be seen in FIG. 11, with the collar portion 612 correctly engaged with the end of the cable 2, a length of the conductors 4 extends from the second end 615 of the socket 614.

Once the collar portion 612 is engaged with the end of the cable 2, a user then moves the identification tag 610 into the second configuration. In this embodiment this is achieved by pressing on the tab portion 616 to bend the hinge portion 642 through approximately 90° in a direction towards the cable 2. Pressure is applied to the tab portion 616 to cause the first and second arms 656 to flex to engage the cable 2. In this way, the tab portion 616 of the identification tag 610 is once again clipped to the cable 2 such that the tab portion 616 extends along the length of the cable 2 with the identification symbols 638 visible, as shown in FIG. 11.

It will be appreciated that either each cable 2 may be processed in sequence, i.e. the end of the cable 2 is prepared and the identification tag 610 repositioned on each cable 2 in turn, or the ends of all of the cables 2 may be prepared and then the identification tag 610 on each cable 2 is repositioned on the cable end one after the other.

Figure 19:
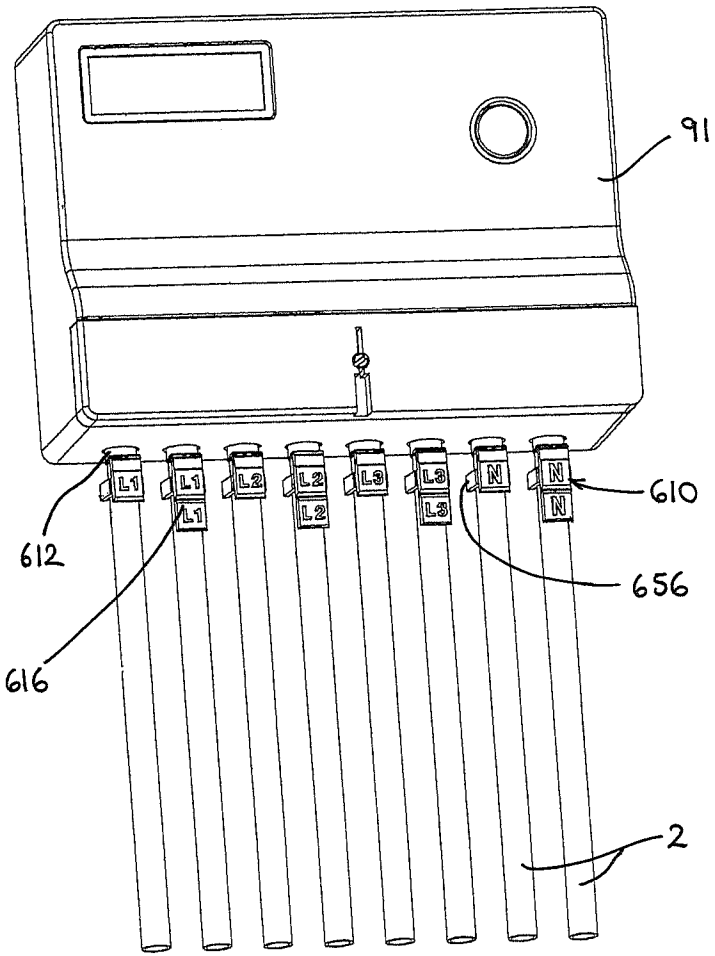
FIG. 19 shows the eight cables of FIG. 18 reconnected to a replacement three phase electricity meter, the identification tags engaged with an end of each of the cables in a second configuration.

Finally, a replacement meter 91 is secured to the mounting surface and all of the cables 2 marked with the identification tags 610 are connected to the appropriate connectors of the replacement meter 91, as illustrated in FIG. 19. With the completion of these connections, all of the identification tags 610 are secured on the respective cables 2 and cannot be released therefrom other than by releasing the cables 2 from the connectors of the meter 91.

Referring again to FIG. 12, an end of the cable 2 is inserted into an aperture 93 in the meter housing 94. The second end 615 of the collar portion 612 is received in a recess 92 in the housing 94 of the replacement meter 91. The second part 622 and/or third part 624 of the socket 614 abuts an inner surface of the recess 92, thereby preventing or restricting access to the conductors 4 and the connector within the meter 91. In particular, the outer surface 644 of the collar portion 612 contacts a surface of the recess 92 surrounding the aperture 93. The shape of the outer surface 644 of the socket 614 means that, even if the cable 2 is flexed or moved relative to the meter 91, a part of the outer surface 644 of the socket 614 remains in contact with the inner surface of the recess 92. Furthermore, the cylindrical shape of the first part 620 of the collar portion 612 means that the identification tag 610 extends substantially perpendicularly from a surface of the meter 91 including the recess 92, and in the second configuration the tab portion 616 extends axially from the collar portion 612. This reduces the possibility of a person levering against the identification tag 610 to create a gap or space between the collar portion 612 and the recess 92.

Figure 13A:
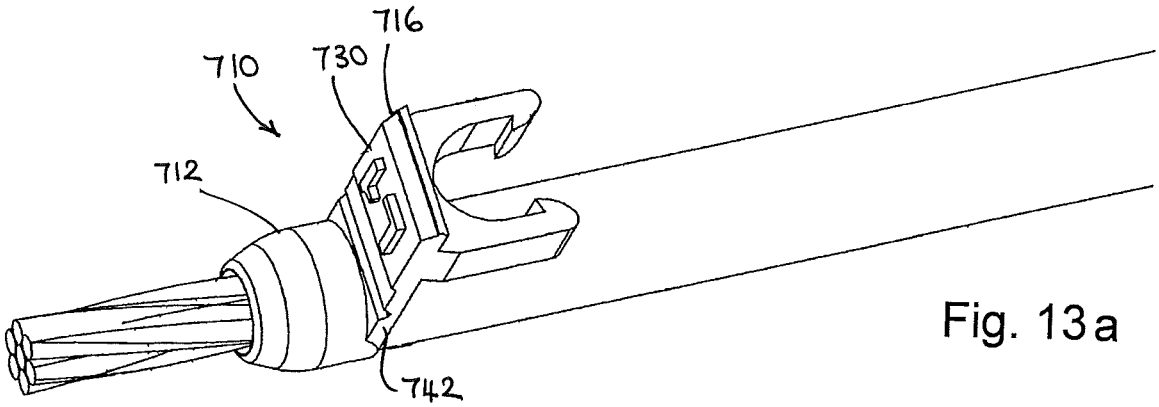
FIG. 13*a* shows an identification tag having a collar portion and a tab portion according to the invention, an end of a cable inserted through the collar portion and the tab portion in a first configuration.
Figure 13B:
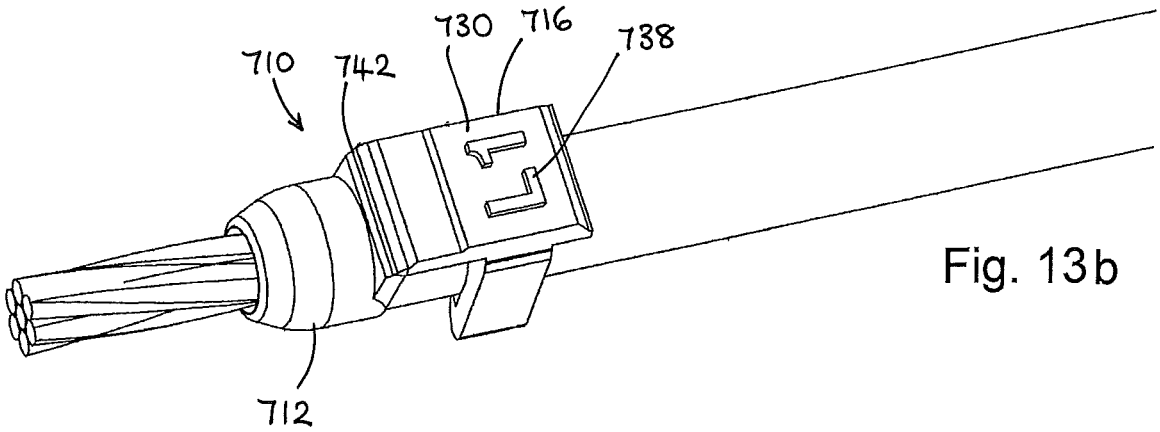
FIG. 13*b* shows the identification tag of FIG. 13*a*, with the tab portion in a second configuration and clipped on to the cable.

In the embodiment of the identification tag 610 shown in FIGS. 10 and 11, the tab portion 616 included two sections 630 each bearing an identification symbol 638 in the form of a letter N. FIGS. 13*a* and 13*b* show another embodiment of an identification tag 710 of this invention in which the tab portion 716 includes only a single section 730 bearing a single identification symbol 738. FIG. 13*a* shows the identification tag 710 in a first configuration in which the tab portion 716 extends radially from the collar portion 712 and FIG. 13*b* shows the identification tag 710 in a second configuration in which the tab portion 716 extends axially from the collar portion 712. A hinge portion 742 between the collar portion 712 and the tab portion 716 allows a user to move the identification tag 710 from the first configuration to the second configuration as described above.

FIGS. 14*a* to 14*f* show an identification tag 810 according to a further preferred embodiment of the invention. Many of the features of this embodiment are the same as or similar to the features of the embodiment of the identification tag 610 shown in FIGS. 10 and 11 and as such will not be described in detail in relation to this embodiment.

Figure 14A:
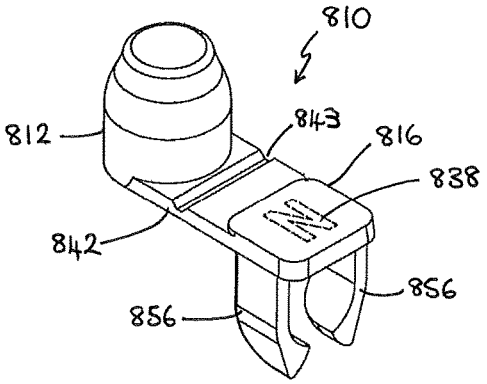
FIGS. 14*a* to 14*d* show an identification tag according to a preferred embodiment of the present invention.
Figure 14B:
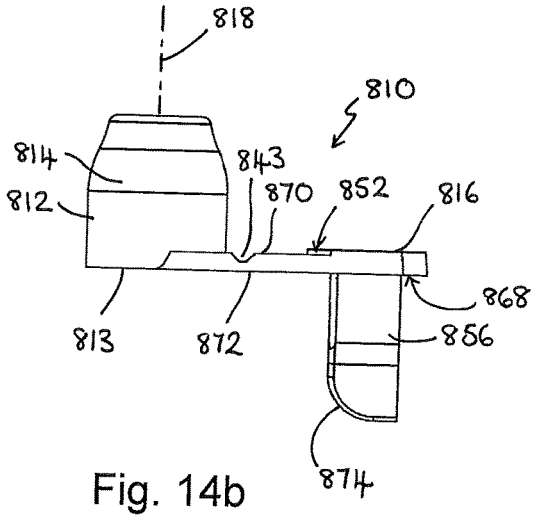
Figure 14C:
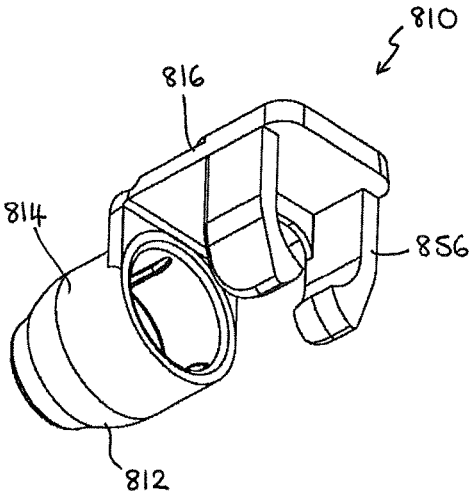
Figure 14D:
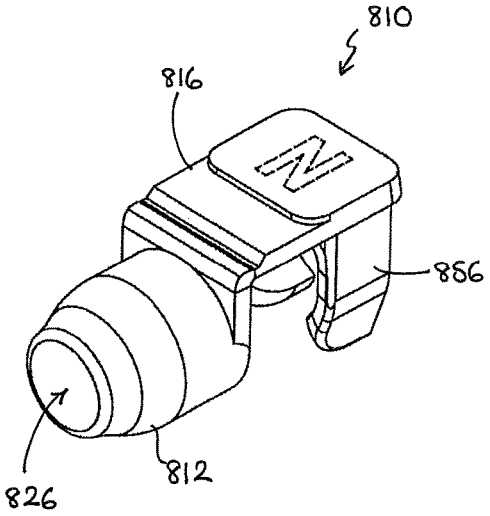
Figure 14E:
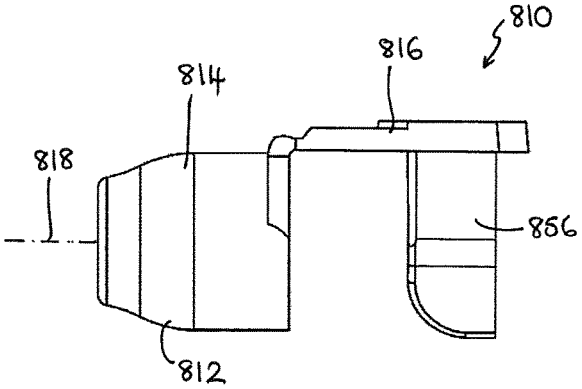
Figure 14F:
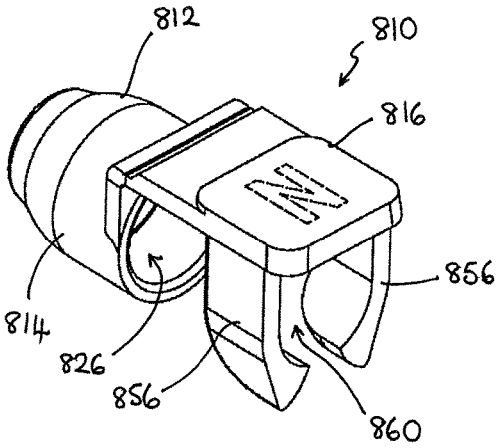
Figure 15A:
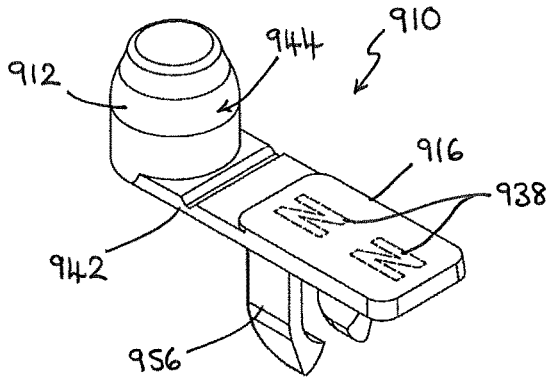
FIGS. 15*a* to 15*d* show a further identification tag according to a preferred embodiment of the present invention.
Figure 15B:
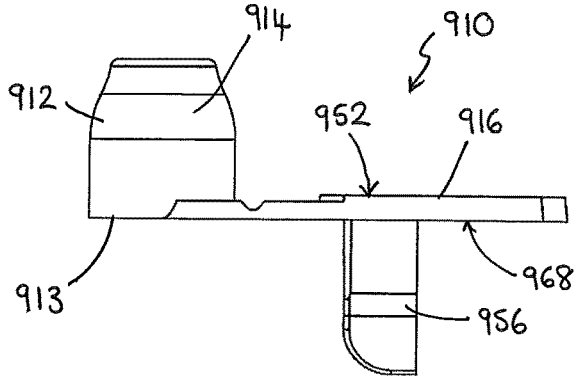
Figure 15C:
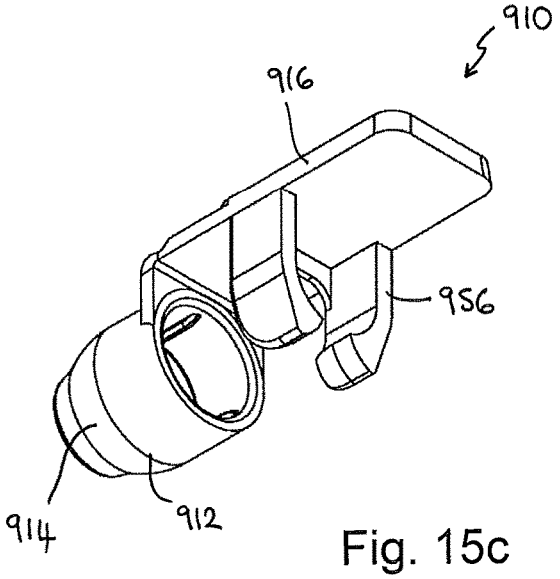
Figure 15D:
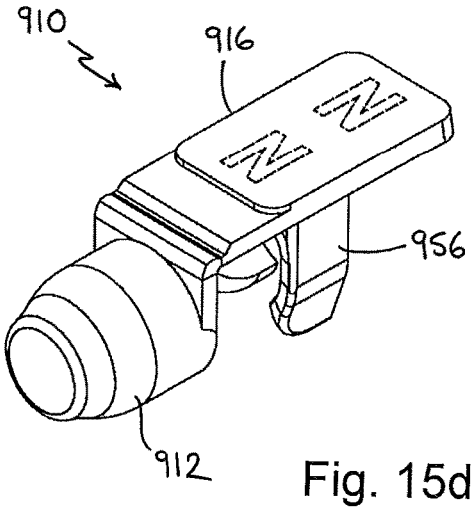
Figure 15E:
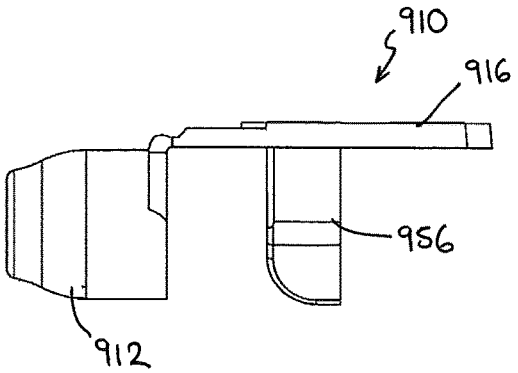
Figure 15F:
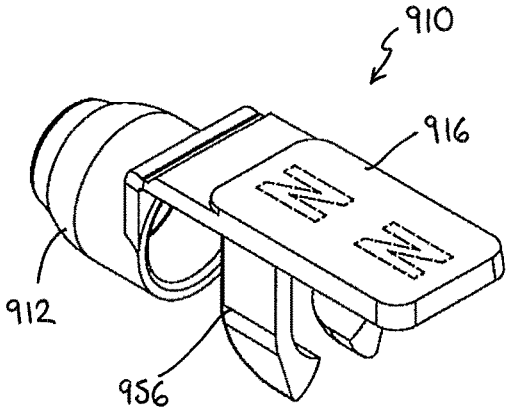

FIGS. 14*a* and 14*b* show the identification tag 810 in a first configuration in which a tab portion 816 extends radially from a collar portion 612. A clip comprising first and second resilient arms 856 extends from the tab portion 816. The clip is positioned close to a distal end of the tab portion 816 furthest from the collar portion 812. The resilient arms 856 extend from a second surface 868 of the tab portion 816. A single identification symbol 838 is provided on a first surface 852 of the tab portion 816 opposite the second surface 868. A hinge portion 842 connects the tab portion 816 to the collar portion 812. The hinge portion 842 comprises a live hinge formed by a thinner region of material. The thinner region is formed by providing a groove 843 in a first surface 870 of the hinge portion 842.

The first surface 870 of the hinge portion 842 is substantially coplanar with the first surface 852 of the tab portion 816. Furthermore, a second surface 872 of the hinge portion 842 is continuous with the second surface 868 of the tab portion 816 and, as shown most clearly in FIG. 14*b*, the second surfaces 872, 868 of the hinge portion 842 and tab portion 816 are in line with the first end 813 of a socket 814 of the collar portion 812.

At least a part of a distal edge of each of the resilient arms 856 is curved. This curved leading edge 874 of each arm 856 makes engagement of the resilient arms 856 with a cable 2 easier as the arms 856 are less likely to dig into the sheath 8 or insulation 6 of the cable 2 and will, instead, be flexed outwards as described above.

FIGS. 14*c* to 14*f* show the identification tag 810 in a second configuration. In this configuration the live hinge is bent at a right angle such that the tag portion 816 extends from the collar portion 812 in a direction substantially parallel to an axis 818 of the socket 814. In this configuration a gap 860 between the resilient arms 856 is axially aligned with a bore 826 of the socket 814. In this configuration, therefore, an elongate cable 2 is able to extend through the gap 860 between the arms 856 and into the socket 814 of the collar portion 812.

FIGS. 15*a* to 15*f* show an identification tag 910 according to a further preferred embodiment of the invention. Many of the features of this embodiment are the same as or similar to the features of the embodiment of the identification tag 810 shown in FIGS. 14*a* to 14*f* and as such will not be described in detail in relation to this embodiment.

In this embodiment a tab portion 916 extends radially from a first end 913 of a collar portion 912 of the identification tag 910. The tab portion 916 is connected to the collar portion 912 by a hinge portion 942 including a live hinge. A first surface 952 of the tab portion 916 includes two identification symbols 938, which in this example are two letters.

A clip comprising first and second resilient arms 956 extends from the tab portion 916. The resilient arms 956 extend from a second surface 968 of the tab portion 916 opposite the first surface 952. The clip is positioned close to a proximal end of the tab portion 916 nearest the collar portion 912. In this way a distal end of the tab portion 916 extends from the clip in a direction away from the collar portion 912.

In the two embodiments of the identification tag 810, 910 shown in FIGS. 14*a* to 14*f* and 15*a* to 15*f* the live hinge of the hinge portion 842, 942 is located adjacent an outer surface 844, 944 of the collar portion 812, 912 at a first end 813, 913 of the collar portion 812, 912. Accordingly, when the identification tag 810, 910 is in the second configuration a minimum length of the hinge portion 842, 942 extends radially outwardly from the socket 814, 914.

An identification tag for fitting on to an electrical cable according to the present invention therefore provides electrical shielding and cable marking at a connection between the cable and an electrical component. As described above, the cable typically has an inner conductor and a surrounding insulation layer, and the connection comprises an end portion of the cable inner conductor connected to a connector within the electrical component. A collar portion of the identification tag comprising a socket configured for receiving the cable and having an abutment shoulder to engage an end of the insulation layer to limit movement of the cable into the socket but to allow a portion of the inner conductor to pass through the socket and into the component whereby in use an interface is formed between the identification tag and the electrical component at the connection. Advantageously the interface between the tag and the electrical component comprises profiles formed on the collar portion of the tag and a recess of the component and which fit closely together to provide electrical shielding at the connection. The identification tag includes a tab portion extending away from the socket and having at least one symbol for identifying the cable at or adjacent said connection.

The identification tag of this invention when in use on a cable connected to an electrical component such as an electricity meter provides enhanced safety at the connection of the cable to an electrical component, by ensuring there is no access to the conductors of the cable at that connection. The profile on the collar portion reduces the likelihood of the insulation layer surrounding the conductors being prised away from the connector on flexing of the cable. In addition, the symbols on the tab portion of the identification tag allows for clear marking and so identification of the cable and this too assists in improving safety for example by maintenance workers.

In some embodiments of the invention an additional advantage is that an electrician requires a smaller inventory of identification tags when effecting a meter-change, as one kind of identification has two uses by appropriate division of the tab portion of the tag.

It is advantageous for the profiles formed on the collar portion and component to fit one within the other when in use thereby to provide electrical shielding at the connection. The external profile of the socket of the collar portion may be of reducing size in the direction away from the tab portion. For example, the external profile of the socket may be of frusto-conical form, or of part-spherical form.

In order to allow use of the identification tag with a smaller diameter cable which might not have an outer sheath surrounding a single layer of insulation around the conductors, or with a larger diameter cable having a layer of insulation surrounding the conductors and most likely an outer sheath surrounding the insulation layer, the socket of the collar portion may have two internal diameters with the smaller diameter nearer the end of the socket having the profile, there being a step such as an annular shoulder between the two diameters.

A method of providing electrical shielding and cable marking at a connection between a cable and an electrical component according to the invention comprises cutting away a surrounding insulation layer from the cable for a predefined distance back from the free end of the cable so that conductors of the cable are exposed for said pre-defined distance;

selecting an identification tag of this invention as described above of an appropriate colour and having one or more appropriate symbols for the cable to be marked; and inserting the cable into the socket of the collar portion so that the exposed conductors extend beyond an end of the socket and the sheath of the cable engages an abutment of the socket; and then connecting the conductors to a connector in the electrical component.

To give sufficient identification of the cable in such a way to meet the current UK and European single phase wiring regulations, at least the tab portion of the identification tag may be one of blue or brown, respectively for use with one of a live or neutral mains cable. These colours would also apply in the UK for a three phase installation, but in many countries of Europe, different colours are used for the three phases of the supply. Similarly, the symbols on the tab portion may consist of at least one letter L or at least one letter N, respectively for use with one of a live or neutral cable, but preferably two or three letters L and preferably two letters N. In the case of identification tags intended for use with the live cables of a three phase system, the symbols would typically be L1, L2 and L3. Again, preferably two such symbols are provided on each tab portion so that one symbol may be removed, depending upon the intended application. Alternatively three such symbols may be provided on each tab portion so that one symbol or two symbols may be removed, depending upon the intended application. Such symbols may be provided by one of printing, raised or depressed surfaces of the tab portion, providing a different surface texture or creating through-apertures in the tab portion, or combinations of these.

When there are at least two symbols on the tab portion, preferably a separation zone is provided between the two symbols. That zone may be a weakened line extending transversely across the tab portion to allow easy separation of a free end section of the tab portion, carrying one or two symbols.

The identification tag preferably comprises a tab portion of generally planar rectangular form and serving as a label, to lie along the outer surface of a cable being marked. Alternatively, the tab portion could extend in a generally radial direction away from the collar portion of the tag. Other shapes of tab portion could be employed for example to assist clarity of the symbols on the tab portion, when in use. The symbols may be arranged serially along the length of the tab portion, or transversely thereof. The identification tag may be provided with means to maintain the tab portion in contact with the cable, such as an integrally-moulded clip engageable with the cable. Another possibility would be for the tab portion to be generally tubular whereby the cable to be identified is passed through the tubular tab portion.

When performing the method of this invention with a cable having a layer of insulation overlying the conductors and a protective sheath overlying the insulation, the step of cutting away the sheath comprises removing back from the free end of the cable a length of the outer sheath and removing back from the free end of the cable a lesser length of the insulation to expose the conductors. Then, before fitting the identification tag to the cable and depending on the intended function of the cable, the tab portion may be shortened to display fewer symbols by breaking off an end section or by cutting or otherwise severing therethrough, between the symbols thereof.

In the above discussion of this invention, reference was made to the replacement of an electricity supply meter; however, it is to be understood that the invention is not to be regarded as limited to such replacement and is applicable to the changing of other kinds of electrical components as well.

For various reasons, it may be necessary to change one electrical component for another having essentially the same function—for example, if the original component has failed or if the replacement component has enhanced characteristics. A particular case in point is with electricity meters; the technology associated with these has evolved and the electricity supply companies are gradually replacing traditional electricity meters with so-called smart meters having additional functionality as compared to a traditional meter. Though both traditional and smart meters are able to measure the quantity of electricity used by a consumer, a smart meter has the additional ability to communicate directly with the electricity supply company and transmit thereto usage measurements, so obviating the need for personal meter reading either by a supply company employee or the consumer. Further, a smart meter may allow the instantaneous usage of electricity to be displayed to a consumer, so assisting the consumer in reducing electricity consumption, and also facilitate the remote control of appliances.

In view of the advantages of smart meters, there is a programme under way in the UK and elsewhere to replace all existing traditional electricity meters with smart meters. This requires a visit by an operative to each existing meter to check and identify the polarity and phase (in the case of a three-phase supply) of the cables connected to the meter before disconnecting the cables from that meter, remove the existing meter and mount the replacement smart meter, and then correctly reconnect the cables to the smart meter. With a simple domestic supply, there will be four cables connected to the traditional electricity meter but with a three phase supply, there will be eight such cables, and there may be further cables connected to the meter for example associated with other supply functionality, such as a night time tariff. Depending upon when the original meter was installed, those cables may carry no identification markings whatsoever, or may be incompletely or inaccurately marked. As such, following disconnection of the cables from the existing meter, there could be a very high risk of confusion as to which cable is which when reconnecting the cables to the replacement meter, unless steps are taken to identify the cables before disconnection from the existing meter.

In an attempt to ensure adequate cable identification for the future, current regulations specify that the cables connected to a new or replacement electricity meter must be appropriately identified, both by colour and symbols typically in the form of letters and/or numerals, to show the function of the cable. These regulations must therefore be adhered to on replacing a meter, but the possible confusion of the cables connected to an existing meter must be addressed in order to ensure that when an existing meter is replaced by a smart meter, the cables are appropriately identified before removal from the existing meter so that the cables are not confused when connected to the connectors of the replacement meter.

The present invention provides a pre-marking method for cables connected to an electrical component such as an electricity meter, to facilitate the replacement of that component by another similar component and ensure the cables are appropriately marked and safely connected to the replacement component.

In particular, the invention provides a method of changing an electrical component having at least two cables connected thereto and using for each cable a clip-on identification tag having a collar portion configured for fitting on to the cable and being provided with a tab portion having at least one symbol to identify the cable with which the tag is to be associated by temporarily clipping the identification tag on to the cable to which the symbol relates. The method is characterised by the steps of identifying the function of each cable connected to the electrical component;

for each identified cable selecting an identification tag suitable for the cable and temporarily clipping the tag to the cable;

disconnecting each cable from the electrical component;

replacing the electrical component by another; and then for each cable, unclipping the tag from the cable and fitting the collar portion of that tag over the end of the cable thereby permanently to identify the cable, and then connecting the cable to the appropriate connector of the replacement electrical component.

The method of this invention, therefore, allows for quick and easy pre-marking of a cable attached to an electrical component such as an electricity meter using an identification tag which subsequently is re-used essentially permanently to mark the cable in accordance with the regulations. It will be appreciated that the term "permanently" as used herein in relation to the marking of cables means that the marker cannot be accidentally or inadvertently removed from the cable or otherwise be displaced from the cable; it can be removed only by disconnecting the cable from the electrical component or by deliberate cutting of and so destroying the tag to free it from the cable.

With this method, a technician needs make only one selection of an appropriate identification tag for each cable before starting the replacement procedure, and then temporarily clipping the selected tag to a cable. After removing the existing component and fitting the replacement, the technician may handle the cables one at a time, by moving the identification tag from its temporary attachment on one cable to the end of that cable to provide the permanent identification. Consequently, the method is both fast and easy to perform with a greatly reduced risk of connection errors. Further, in its preferred form the method may provide a safety collar for the cable, ensuring a safe connection of the cable to the electrical component Preferably, the identification tag has an integral clip profiled for connection to the cable. Such a clip may be provided on the tag to allow the temporarily connection of the tag to the cable at some convenient point along the length of the cable but advantageously near to the existing component. In one embodiment, the clip has a pair of arms profiled to define a re-entrant slot and the tag is temporarily attached by springing the arms of the clip around the cable. In this case, after removal of the cable from the existing component and following the fitting of the collar portion to a cable end, and either before or after the connection of the cable to the replacement electrical component, the tab portion of the tag may be flexed or folded over to engage the clip with the cable, once more. To facilitate this, there may be a weakened zone to serve as a hinge between the collar portion and the tab portion, such that the folding over of the tab portion is performed about the hinge.

The method of this invention will usually be performed with a cable having conductors surrounded by a layer of insulation. A collar portion of the identification rag may have a bore through which the conductors of the cable are passed on fitting the tag to the cable, but the bore is of insufficient diameter to allow the outer layer to pass therethrough, such that the tag when fitted to the cable remains at the end region thereof. Preferably, the bore of the collar portion has a counter-bore at an end thereof adjacent the tab portion, so that on fitting the collar portion to the cable, the conductors of the cable are passed through the bore and the outer insulation layer is received in the counter-bore but cannot pass through the bore of the collar portion. In a case where a cable has conductors surrounded by a layer of insulation which is itself surrounded by an outer sheath, when fitting the collar to the cable, the conductors of the cable are passed through the bore, the layer of insulation is received in the counter-bore but cannot pass through the bore of the collar, and the outer sheath abuts an end of the collar adjacent the tab portion.

When performing the method, following removal of a cable from the electrical component it may be preferred for at least the exposed conductors of the cable to be cut off, and a fresh strip to be performed on the outer layer of the cable end portion to expose the conductors. If the cable has a layer of insulation and an outer sheath, following removal of a cable from the electrical component, preferably at least the exposed conductors of the cable are cut off and a fresh a two-level strip is performed on the cable such that the conductors are exposed at the end of the cable and a short length of the layer of insulation is exposed between the conductors and the outer sheath.

Preferably, the tab portion of an identification tag carries two cable-identifying symbols typically in the form of letters and/or numerals arranged serially along the tab portion, so that before the temporary clipping of the tag to a cable the symbol further from the collar portion may be selectively removed or not removed from the tag, to suit the function of the cable to which the tag is clipped. The tab portion may have a weakened zone between the symbols thereon, whereby the symbol further from the collar portion may be removed by cutting along the weakened zone or by breaking the tab portion along the weakened zone and leaving part of the tab portion having the symbol nearer the collar portion still attached thereto.

What is claimed is:

1. An identification tag for attachment to an end of an electrical cable, said cable end having a length of exposed inner conductor beyond an end of a surrounding layer, and the tag comprising:

a collar portion comprising:

a bore for receiving a part of the cable, the bore extending between first and second ends of the collar portion, wherein: the bore comprises a first section at the first end of the collar portion and a second section at the second end of the collar portion; the first section has a first diameter; and the second section has a second diameter that is smaller than the first diameter;

an abutment surface for limiting insertion of the cable end through the bore, wherein the abutment surface comprises a step in the bore between the first and second sections, and is configured to engage with the end of the surrounding layer to prevent further insertion of the cable end into the bore; and an outer surface having a profile such that an outer diameter of the collar portion is smaller at the second end than at the first end and the outer diameter of the collar portion decreases gradually from the first end to the second end; and a tab portion connected to and extending from the collar portion, the tab portion comprising one or more identification-symbols for identifying said cable.

2. The identification tag of claim 1, wherein at least a part of the outer surface of the collar portion has a tapered profile.

3. The identification tag of claim 1, wherein a part of the outer surface of the collar portion is dome-shaped.

4. The identification tag of claim 1, wherein a part of the outer surface nearest the first end of the collar portion has a cylindrical shape.

5. The identification tag of claim 1, wherein:

the profile of the outer surface of the collar comprises:

a first part nearest the first end of the collar portion having a cylindrical shape;

a second part extending from the first part having a tapered profile; and a third part nearest the second end of the collar portion having a tapered profile; and an angle of the taper of the third part is greater than an angle of the taper of the second part.

6. The identification tag of claim 1, wherein the step comprises an annular shoulder.

7. The identification tag of claim 1, wherein the bore comprises a counter bore at an end thereof that is adjacent the tab portion, such that when the surrounding layer of the cable is received in the counterbore it abuts the counterbore and cannot pass through the bore.

8. The identification tag of claim 1, wherein the profile of the outer surface of the collar portion reduces in size in a direction away from the tab portion.

9. The identification tag of claim 1, further comprising a clip connected to the tab portion, wherein the clip is configured to attach the tag to a cable.

10. The identification tag of claim 9, wherein:

the clip comprises a pair of resilient arms extending from the tab portion; and the resilient arms are spaced apart to define a gap for receiving said cable.

11. The identification tag of claim 10, wherein the resilient arms extend from opposite edges of the tab portion.

12. The identification tag of claim 10, wherein the identification symbols are provided on a first face of the tab portion and the resilient arms extend in a direction opposite to the first face.

13. The identification tag of claim 10, wherein each of the resilient arms include a distal end region and a projection extending from the distal region into said gap.

14. The identification tag of claim 9, wherein said tab portion comprises a distal end section that extends beyond the clip in a direction away from the collar portion.

15. The identification tag of claim 1, further comprising a hinge portion connecting the tab portion to the collar portion, wherein:

the hinge portion is configured to permit movement of the tab portion relative to the collar portion between a first configuration in which the tab portion extends from the collar portion in a direction transverse to an axis of the collar portion and a second configuration in which the tab portion extends from the collar portion in a direction substantially parallel to the axis; and the axis is defined by the bore of the collar portion.

16. The identification tag of claim 15, wherein the hinge portion includes a live hinge.

17. The identification tag of claim 15, wherein the hinge portion comprises a flexible member.

18. The identification tag of claim 1, wherein the tag is made from a plastic material.

19. The identification tag of claim 1, wherein the tab portion comprises two sections and a separation zone between the two sections, wherein the separation zone is configured to enable removal of one of the two sections from the identification tag.

20. The identification tag of claim 1, wherein the tab portion comprises first, second, and third sections, a first separation zone between the first and second sections, and a second separation zone between the second and third sections, wherein the first and second separation zones are each configured to enable removal of at least one of the first, second, and third sections from the identification tag.

21. The identification tag of claim 20, wherein the first, second, and third sections of the tab portion further comprises identical symbols that are arranged serially along a length of the tab portion.

22. A method of shielding an end of an electrical cable using an identification tag, said cable end having a length of exposed inner conductor beyond an end of a surrounding layer, the method comprising:

inserting said cable end through a bore of a collar portion of the identification tag from a first end to a second end of the collar portion until the end of the surrounding layer contacts an abutment surface;

wherein:

an outer surface of the collar portion has a profile such that an outer diameter of the collar portion is smaller at the second end than at the first end and the outer diameter of the collar portion decreases gradually from the first end to the second end;

the bore comprises a first section at a first end of the collar portion and a second section at a second end of the collar portion, the first section having a first diameter, and the section having a second diameter smaller than the first diameter;

the abutment surface comprises a step in the bore between the first and second sections;

the identification tag comprises a tab portion connected to and extending from the collar portion; and the tab portion comprises one or more identification symbols for identifying said cable.

23. The method of claim 22, further comprising, connecting the distal end of the exposed conductor to an electrical component after inserting the cable end through the bore of the collar portion.

24. The method of claim 23, wherein the electrical component includes an aperture in a housing of the component and a recess surface surrounding the aperture, and the method further comprises inserting the cable end into the aperture and seating the outer surface of the collar portion in contact with the recess surface.

25. An assembly comprising:

an electrical component;

a cable; and an identification tag comprising a collar portion and a tab portion;

wherein:

the collar portion comprises a bore, an abutment surface, and an outer surface;

the bore extends between first and second ends of the collar portion;

the bore comprises a first section at a first end of the collar portion and a second section at a second end of the collar portion, the first section having a first diameter, and the section having a second diameter smaller than the first diameter;

the abutment surface comprises a step in the bore between the first and second sections;

the outer surface has a profile such that an outer diameter of the collar portion is smaller at the second end than at the first end and the outer diameter of the collar portion decreases gradually from the first end to the second end;

the tab portion is connected to and extends from the collar portion, and comprises one or more identification symbols for identifying a cable;

the cable comprises an inner conductor and a surrounding layer, wherein a length of the inner conductor is exposed beyond an end of the surrounding layer at an end of the cable;

the identification tag is engaged with the end of the cable such that at least a portion of the cable is in contact with the abutment surface;

the electrical component comprises a connector for forming an electrical connection with the conductor of the cable; and the end of the cable is connected to the electrical component such that a part of the outer surface of the collar portion of the tag is in contact with a surface of the electrical component to restrict access to the connector and the exposed conductor.

26. The assembly of claim 25, wherein:

the electrical component comprises an aperture in a housing of the component and a recess surface surrounding the aperture; and part of the outer surface of the collar portion is seated in contact with the recess surface.

* * * * *